US006865978B2

(12) United States Patent
Kash

(10) Patent No.: US 6,865,978 B2
(45) Date of Patent: Mar. 15, 2005

(54) WELL PERFORATING GUN

(75) Inventor: Edward C. Kash, 1010 Alkire Lake Dr., Sugarland, TX (US) 77478

(73) Assignee: Edward C. Kash, Sugar Land, TX (US)

( * ) Notice: Subject to any disclaimer, the term of this patent is extended or adjusted under 35 U.S.C. 154(b) by 0 days.

(21) Appl. No.: 10/370,142

(22) Filed: Feb. 18, 2003

(65) Prior Publication Data

US 2004/0107825 A1 Jun. 10, 2004

Related U.S. Application Data

(60) Provisional application No. 60/431,446, filed on Dec. 5, 2002.

(51) Int. Cl.[7] ..... E21B 43/116

(52) U.S. Cl. ..... 89/1.15; 102/313; 175/2

(58) Field of Search ..... 89/1.15; 175/2, 175/3, 3.5, 4, 4.51, 4.6, 4.52, 4.53; 166/297; 102/311, 312, 331

(56) References Cited

U.S. PATENT DOCUMENTS 2,649,046 A * 8/1953 Davis ..... 102/310
2,750,885 A * 6/1956 Schlumberger ..... 175/4.6
2,980,017 A * 4/1961 Castel ..... 175/4.6
5,775,426 A * 7/1998 Snider et al. ..... 166/308.1
5,960,894 A * 10/1999 Lilly et al. ..... 175/4.6
6,336,506 B2 * 1/2002 Wesson ..... 166/308.1
6,520,258 B1 * 2/2003 Yang et al. ..... 166/297
6,679,327 B2 * 1/2004 Sloan et al. ..... 166/297
2002/0134585 A1 * 9/2002 Walker ..... 175/4.51

* cited by examiner

*Primary Examiner*—Aileen Felton
*Assistant Examiner*—Gabriel S. Sukman
(74) *Attorney, Agent, or Firm*—Wendy Buskop; Buskop Law Group, P.C.

(57) ABSTRACT

The borehole of many wells, including oil and gas production wells, is frequently cased with a steel or similar metal casing. In order to extract oil or other material existing within the surrounding geologic formation, it is necessary to puncture the casing. Currently, this is accomplished with tubes (guns) containing explosive charges being lowered into the well bore and detonated, causing the tube and well casing to be punctured and the geologic formation shattered. The guns are made from high strength, thick-walled and machined metal. This invention discloses a multi-layered or composite tube that enhances the directional orientation of the explosive charges utilizing less costly and more easily fabricated material. The invention also discloses a gun having properties to allow the desired directionally oriented perforation by the explosive charge without being deformed and jammed within the well casing. Other advantageous are also disclosed.

9 Claims, 20 Drawing Sheets

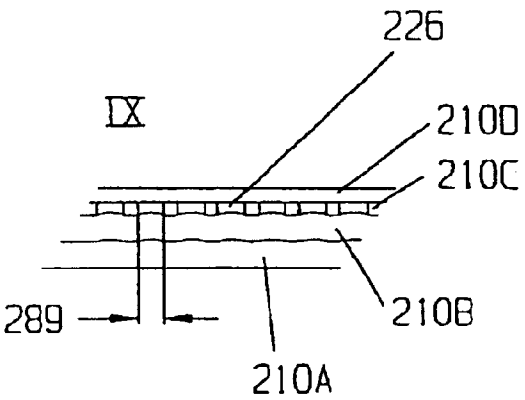
FIG. 9A2
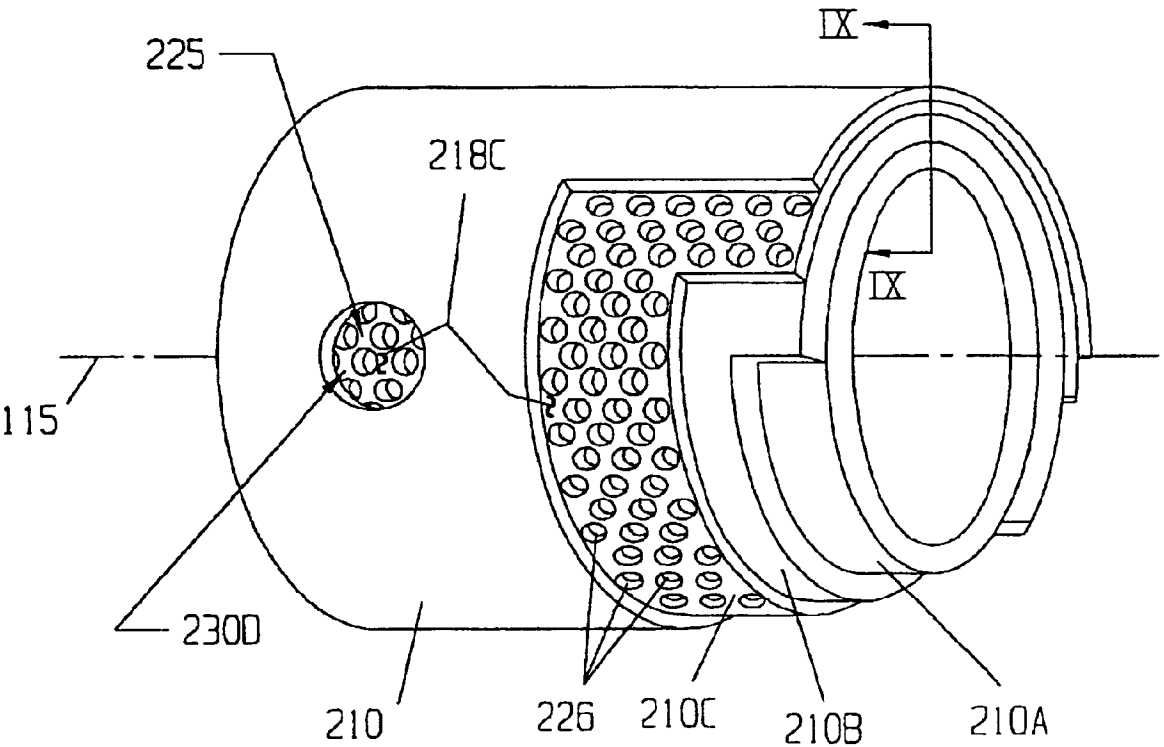
FIG. 9A1

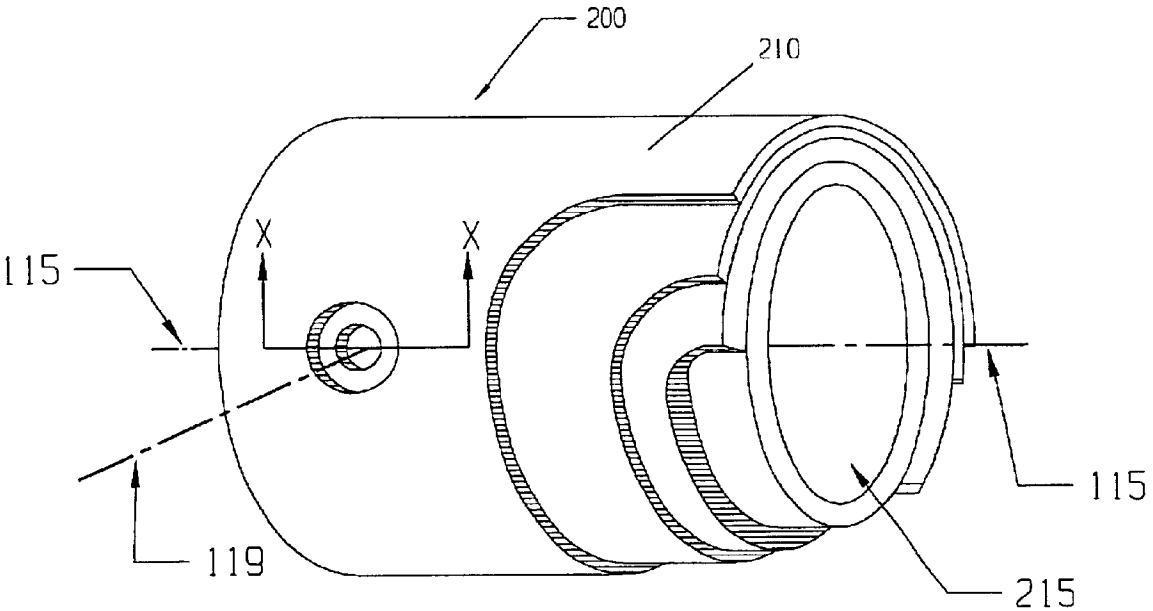
FIGURE 10
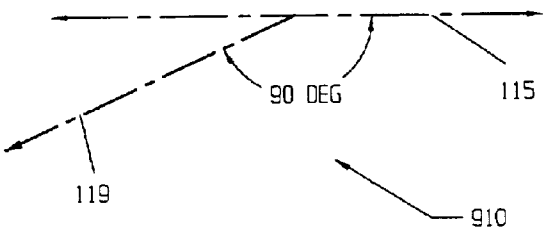

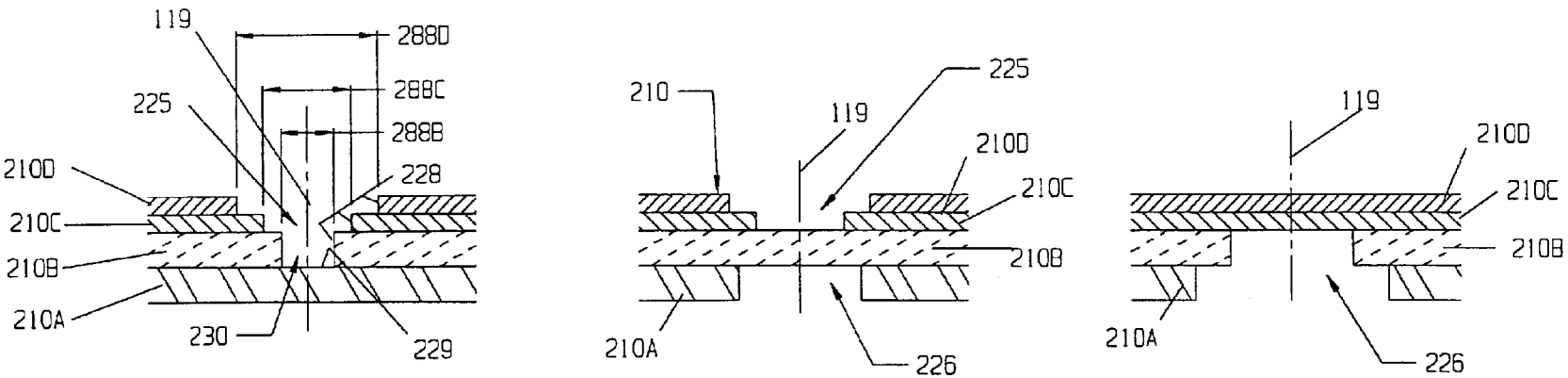
MULTIPLE O.D. RECESSES
FIGURE 10A
I.D. AND O.D. RECESSES
FIGURE 10B
MULTIPLE I.D. RECESSES
FIGURE 10C
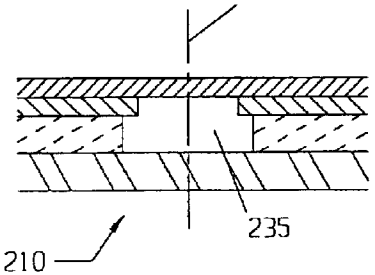
INTERNAL RECESSES
FIGURE 10D
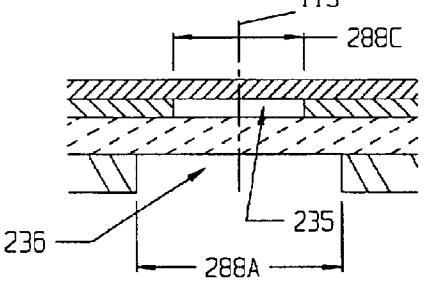
COMBINATION RECESSES
FIGURE 10E

WELL PERFORATING GUN

CROSS REFERENCE TO RELATED APPLICATION

This application claims the benefit of and priority to U.S. Provisional Application 60/431,446, filed Dec. 5, 2002 and entitled Well Perforating Gun.

BACKGROUND

1. Field of Use

Well completion techniques normally require perforation of the ground formation surrounding the borehole to facilitate the flow of interstitial fluid (including gasses) into the hole so that the fluid can be gathered. In boreholes constructed with a casing such as steel, the casing must also be perforated. Perforating the casing and underground structures can be accomplished using high explosive charges. The explosion must be conducted in a controlled manner to produce the desired perforation without destruction or collapse of the well bore.

Hydrocarbon production wells are usually lined with steel casing. The cased well, often many thousands of feet in length, penetrates varying strata of underground geologic formations. Only few of the strata may contain hydrocarbon fluids. Well completion techniques require the placement of explosive charges within a specified portion of the strata. The charge must perforate the casing wall and shatter the underground formation sufficiently to facilitate the flow of hydrocarbon fluid into the well as shown in FIG. 1. However, the explosive charge must not collapse the well or cause the well casing wall extending into a non-hydrocarbon containing strata to be breached. It will be appreciated by those skilled in the industry that undesired salt water is frequently contained in geologic strata adjacent to a hydrocarbon production zone, therefore requiring accuracy and precision in the penetration of the casing.

The explosive charges are conveyed to the intended region of the well, such as an underground strata containing hydrocarbon, by a multi-component perforation gun system ("gun systems," or "gun string"). The gun string is typically conveyed through the cased well bore by means of coiled tubing, wire line, or other devices, depending on the application and service company recommendations. Although the following description of the invention will be described in terms of existing oil and gas well production technology, it will be appreciated that the invention is not limited to those applications.

2. Existing Technology

Typically, the major component of the gun string is the "gun carrier" tube component (hereinafter called "gun") that houses multiple shaped explosive charges contained in lightweight precut "loading tubes" within the gun. The loading tubes provide axial and circumferential orientation of the charges within the gun (and hence within the well bore). These tubes allow the service company to preload charges in the correct geometric configuration, connect the detonation primer cord to the charges, and assemble other necessary hardware. This assembly is then inserted into the gun as shown in FIG. 2. Once the assembly is complete, other sealing connection parts are attached to the gun and the completed gun string is lowered into the well bore by the conveying method chosen. The gun is lowered to the correct down-hole position within the producing zone, and the charges are ignited producing an explosive high-energy jet of very short duration (see FIG. 3). This explosive jet perforates the gun and well casing while fracturing and penetrating the producing strata outside the casing. After detonation, the expended gun string hardware is extracted from the well or released remotely to fall to the bottom of the well. Oil or gas (hydrocarbon fluids) then enters the casing through the perforations. It will be appreciated that the size and configuration of the explosive charge, and thus the gun string hardware, may vary with the size and composition of the strata, as well as the thickness and interior diameter of the well casing.

Currently, cold-drawn or hot-rolled tubing is used for the gun carrier component and the explosive charges are contained in an inner, lightweight, precut loading tube. The gun is normally constructed from a high-strength alloy metal. The gun is produced by machining connection profiles on the interior circumference of each of the guns ends and "scallops," or recesses, cut along the gun's outer surface to allow protruding extensions ("burrs") created by the explosive discharge through the gun to remain near or below the overall outside diameter of the gun. This method reduces the chance of burrs inhibiting extraction or dropping the detonated gun. High strength materials are used to construct guns because they must withstand the high energy expended upon detonation. A gun must allow explosions to penetrate the gun body, but not allow the tubing to split or otherwise lose its original shape (FIG. 4.) Extreme distortion of the gun may cause it to jam within the casing. Use of high strength alloys and relatively heavy tube wall thickness has been used to minimize this problem.

Guns are typically used only once. The gun, loading tube, and other associated hardware items are destroyed by the explosive discharge. Although effective, guns are relatively expensive. Most of the expense involved in manufacturing guns is the cost of material. These expenses may account for as much as 60% or more of the total cost of the gun. The oil well service industry has continually sought a method or material to reduce this cost while also seeking to minimize the possibility of misdirected explosive discharges or jamming of the expended gun within the well.

Although the need to ensure gun integrity is paramount, efforts have been made to use lower cost steel alloys through heat-treating, mechanical working, or increasing wall thickness in lower-strength but less expensive materials. Unfortunately, these efforts have seen only limited success. Currently, all manufacturers of guns are using some variation of high-strength, heavy-wall metal tubes.

SUMMARY OF INVENTION

The existing technology, requiring use of heavy-wall, high-alloy metal tubing to minimize gun wall failure, does not completely address the dynamic nature of the short duration, high-temperature, and high-pressure energy pulse used in the perforation process. Current technology suggests that ultimate material strength or strain to failure ratio determines the ability to withstand the high energy pulse. Selecting a material upon its ultimate tensile strength and then fracture, will include the measure of material properties similar to a balloon being inflated until the rubber can no longer hold the pressure and then ruptures catastrophically. The existing technology has been to minimize this problem by increasing the strength and wall thickness of the gun until the internal pressure is successfully contained during perforation. Gun wall thickness is also required to prevent wall collapse due to the high static pressures encountered in deep wells. This static pressure, however, is less than the outward and internally generated pressure from explosive detonation.

This invention, therefore, includes a novel gun design and method of manufacture utilizing the shock absorptive (impact strength) properties of materials in contrast to the selection of material based upon ultimate tensile strength. For the purpose of illustration, steel can be compared to taffy. If stretched slowly, taffy continues to grow thin and elongate; but, if pulled very rapidly, it will break before any significant elongation occurs. Most common high-carbon steels easily fracture when struck at low temperatures, but these same steels will exhibit predictable ultimate tensile strengths if placed in tension and loaded slowly. Add alloying elements to these steels, and they no longer easily fracture, but will exhibit similar ultimate tensile strengths when loaded to failure as high-carbon, unalloyed steel.

The outer surface of the gun tube is the most highly stressed area and is placed in pure tension during the brief but highly intense pulse of explosive energy upon detonation (FIG. 5). Prior to the invention subject of this disclosure, gun material has been homogeneous and monolithic, resulting in immediate and unimpeded (unbuffered) transfer of the high-energy pulse from the interior circumference to the outer surface of the gun. Imperfections near or at the outer surface of the steel tube will become stress risers, and impact fractures can occur. Of particular note here are the scallop recesses that are machined into the surface of the guns at the very points of maximum pressure (FIG. 6). These planned surface irregularities may very well exacerbate the fracture problem. In addition, the use of a high-strength monolithic material frequently results in burrs adjacent to the points where the explosive charge exits the gun. These burrs protrude outward from the outer surface of the gun, and can cause the gun to jam in the casing or retard the effectiveness of the explosive charge intended to penetrate through the casing and fracture the formation.

Existing technology uses guns constructed of solid, homogeneous material having no engineered energy arrestors or cracking arrestors. In addition, the current industry practice of cutting scallops into the outer gun surface sharply interrupts the surface continuity of the gun. This scalloped outer material will significantly decrease the gun's ability to withstand tensile shock.

Existing technology typically requires an alloyed and, preferably, a heat-treated steel (quenched and tempered) to ensure adequate shock absorption or resistive strength in the gun wall. These materials are expensive and have a limited number of producers. Mill runs are required, and logistical problems are inherent in ordering and shipping. Economical alternatives to the heavy wall tubing are limited. Alloy additions or mechanical/thermal treatments are relatively expensive. The restricted space within a down-hole well casing also limits the ability to increase wall thickness. The relatively limited number of sources and the special material requirements limit opportunities for cost saving.

Efforts to achieve cost savings by increasing the batch size of casing wall mill runs restricts the flexibility to modify individual gun designs based on material type, wall thickness, recess design, and gun strings to accommodate the characteristics of strata and well casings encountered in the field. This limitation can hamper the effectiveness of the gun string and cause expensive delays in well production. Therefore, the objects of this invention are as follows:

To support the design and construction of a gun capable of withstanding the short but high-energy pulse of an explosion without requiring use of expensive materials with high ultimate tensile strengths.

To support the design and construction of a gun having shock absorptive and energy transfer characteristics, thereby reducing the occurrence of a catastrophic failure due to imperfections or a latent structural flaw in the gun material.

To create internal shock or crack arrestors in the gun to reduce gun failure and misdirected explosive discharges.

To reduce the amount of material machining, particularly the precision machining of outer scallops on the gun.

To reduce stress risers created at the scallops during the detonation of an explosive discharge.

To reduce the formation of burrs on the gun.

To reduce the cost of fabrication or simplify the fabrication process to allow increased sources of supply.

To allow reduction of space between the outer surface of the gun and the inside surface of the casing, thereby increasing the effective focus or channel of the explosive pulse.

To facilitate the modification of gun size and configuration for individual applications.

Other benefits included in the scope of the invention will also become apparent to those skilled in the art.

SUMMARY OF DRAWINGS

The accompanying drawings, which are incorporated in and constitute a part of the specification, illustrate preferred embodiments of the invention. These drawings, together with the general description of the invention above and the detailed description of the preferred embodiments below, serve to explain the principles of the invention.

FIGS. 9A1 and 9A2 illustrate a detailed embodiment of the invention employing energy absorption zones.

FIG. 10 and FIGS. 10A through 10F illustrate detailed embodiments of the invention employing various designs for precut recesses in gun wall layers.

FIG. 13 illustrates attachment of end fittings to perforating guns subject of the invention.

The above general description and the following detailed description are merely illustrative of the subject invention, additional modes, and advantages. The particulars of this invention will be readily suggested to those skilled in the art without departing from the spirit and scope of the invention.

DETAILED DESCRIPTION OF INVENTION

The invention disclosed herein incorporates novel engineering criteria into the design and fabrication of well perforating guns. This criterion addresses multiple requirements. First, the gun material's (steel or other metal) ability to withstand high shocks delivered over very short periods of time ("impact strength") created by the simultaneous detonation of multiple explosive charges ("explosive energy pulse" or "pulse") is more important than the material's ultimate strength. This impact strength is measurable and is normally associated with steels with 200 low carbon content and/or higher levels of other alloying elements such as chromium and nickel. Second the shock of the explosion transfers its energy immediately to the outside surface of the tubing. Any imperfections, including scallops, will act as stress risers and can initiate cracking and failure.

Figure 1:
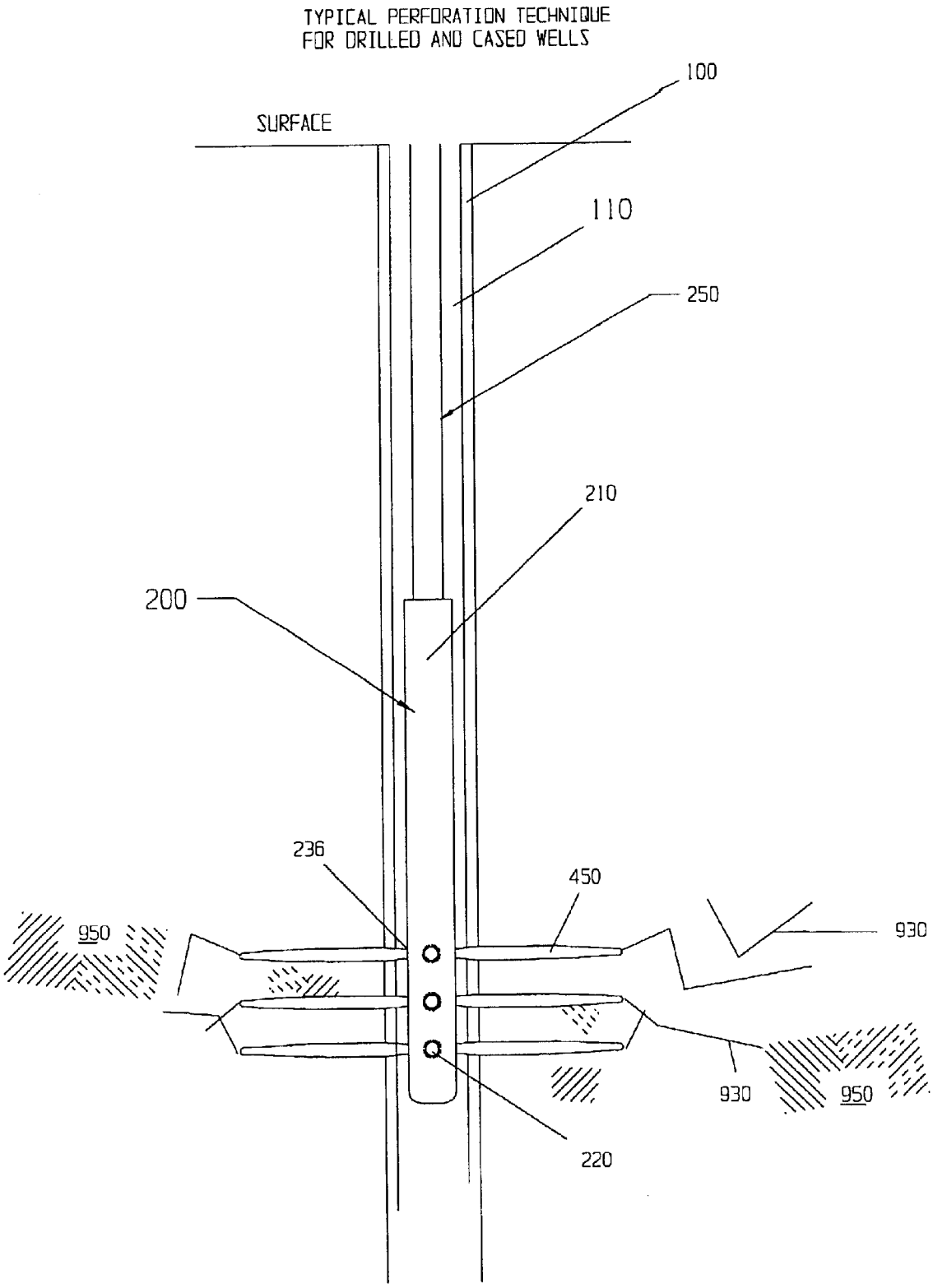
FIG. 1 illustrates the affect of the explosive discharge from a well perforating gun penetrating through the well casing and into the surrounding geologic formation.

FIG. 1 illustrates the basic casing perforation operation in which the tool and fabrication method disclosed in this specification are utilized. The gun 200 is suspended within the well bore 110 by a coil tube or wire line device 250. The charges (not shown) contained within the gun are oriented in 90 degrees around the circumference of the gun. The explosive gas jet 450 produced by detonation of the charge penetrates 236 through the wall 210 of the gun 200 and well casing 100 creating fractures 930 in the adjacent strata 950. Penetration of the gun wall is intended to occur at machined recesses 220 in the wall 210. The recesses are fabricated in a selected pattern around the circumference of the gun.

It is desirable to use various arrangements or orientations of the charges ("shots") and with varying numbers of charges within a given area ("shot density"). This allows variation in the effect and directionally of the explosive charges. Shots are typically arranged in helical orientation (not shown) around the wall of the gun 200 as well as in straight lines parallel to the axial direction of the gun tube. The arrangements are defined by the application and the design engineers' requirements, but are virtually limitless in variation. Guns are typically produced in increments of 5 feet, with the most common gun being about 20 feet. These guns can hold and fire as many as 21 charges for every foot of gun length. Perforation jobs may require multiple combinations of 20-foot sections, which are joined together, to, and by threaded screw-on connectors.

Figure 2:
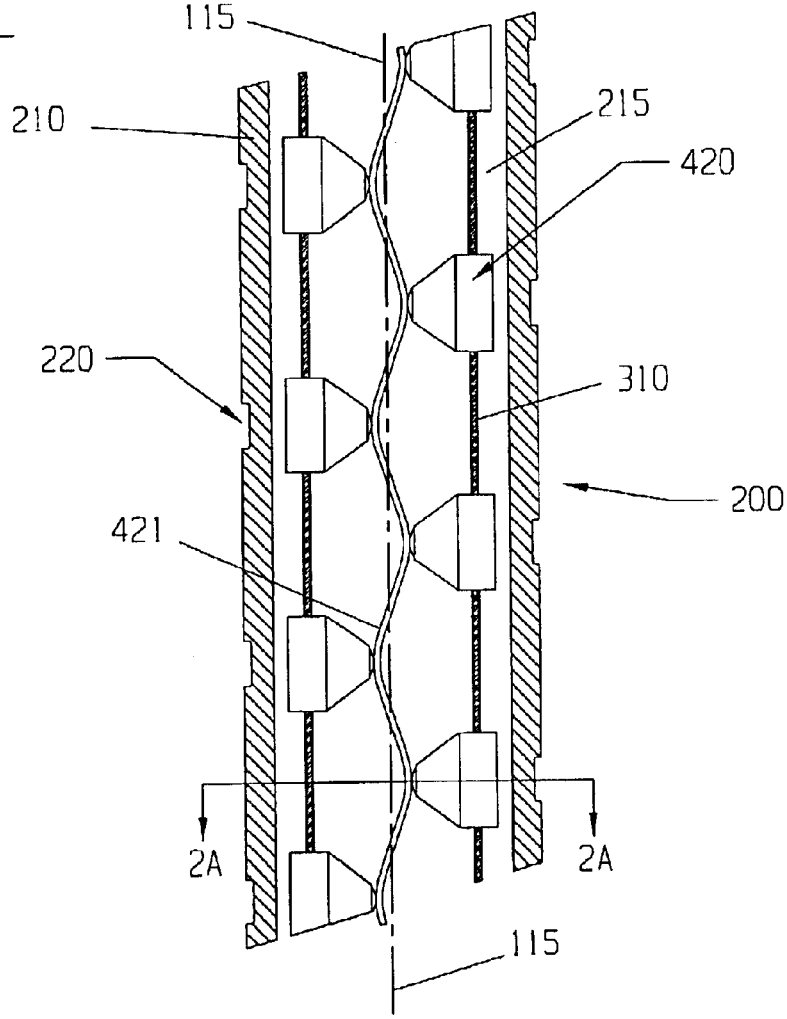
FIGURE 2 PRIOR ART
FIG. 2 illustrates typical alignment of scallops and explosive charges within the gun utilizing existing technology.

FIG. 2 illustrates the basic components of the gun 200 and the relationships between the gun wall 210, loading tube 310, charges 420, and detonation cord 421. The longitudinal axis 115 of the gun is parallel to the axis of the borehole (not shown). The line shown as 2A—2A illustrates the location of the sectional view depicted in FIG. 2A.

Figure 2A:
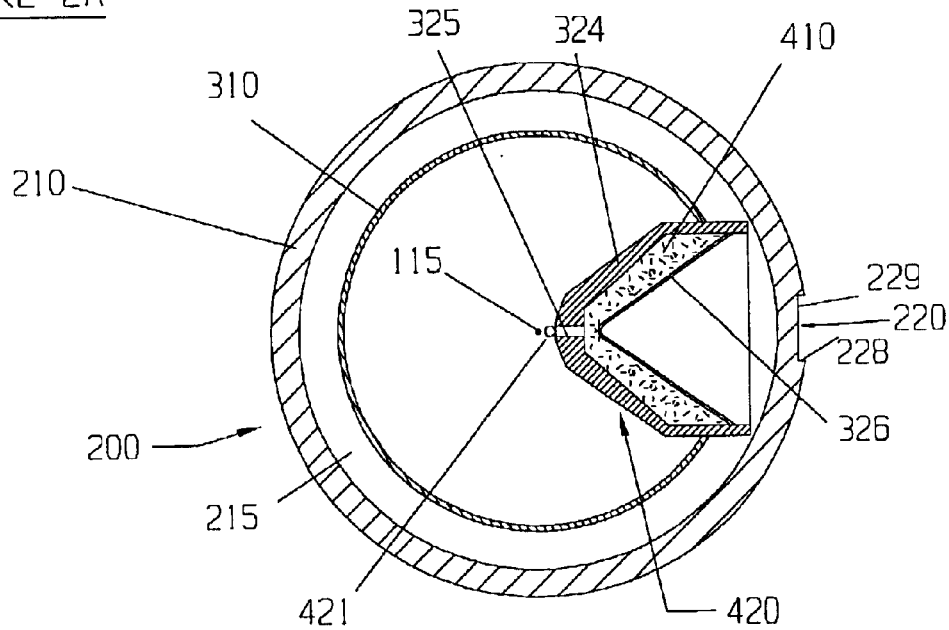
FIG. 2A illustrates a cross-section view of the gun and the typical placement of the explosive charges held within the loading tube.

FIG. 2A is a sectional top view of the gun 200. The relationship of the gun wall 210 to the loading tube 310, containing the charge 420, and the longitudinal axis 115 is illustrated. The loading tube and charge(s) are located within the annulus 215 of the gun wall 210. Also shown is a recess or scallop 220 machined into the outer surface of the gun wall at locations specified to be immediately adjacent to each explosive charge. The recess 220 includes a flat bottom 229 and walls orthogonal 228 to the bottom. The charge 420 includes the explosive charge 410, shape charge body 324, primer vent 325 and retainer cone 326.

It will be appreciated that differing well conductions, casings, strata, and so on create the need for varying configurations and properties of the loading tubes, charges, and mounting hardware.

Figure 3:
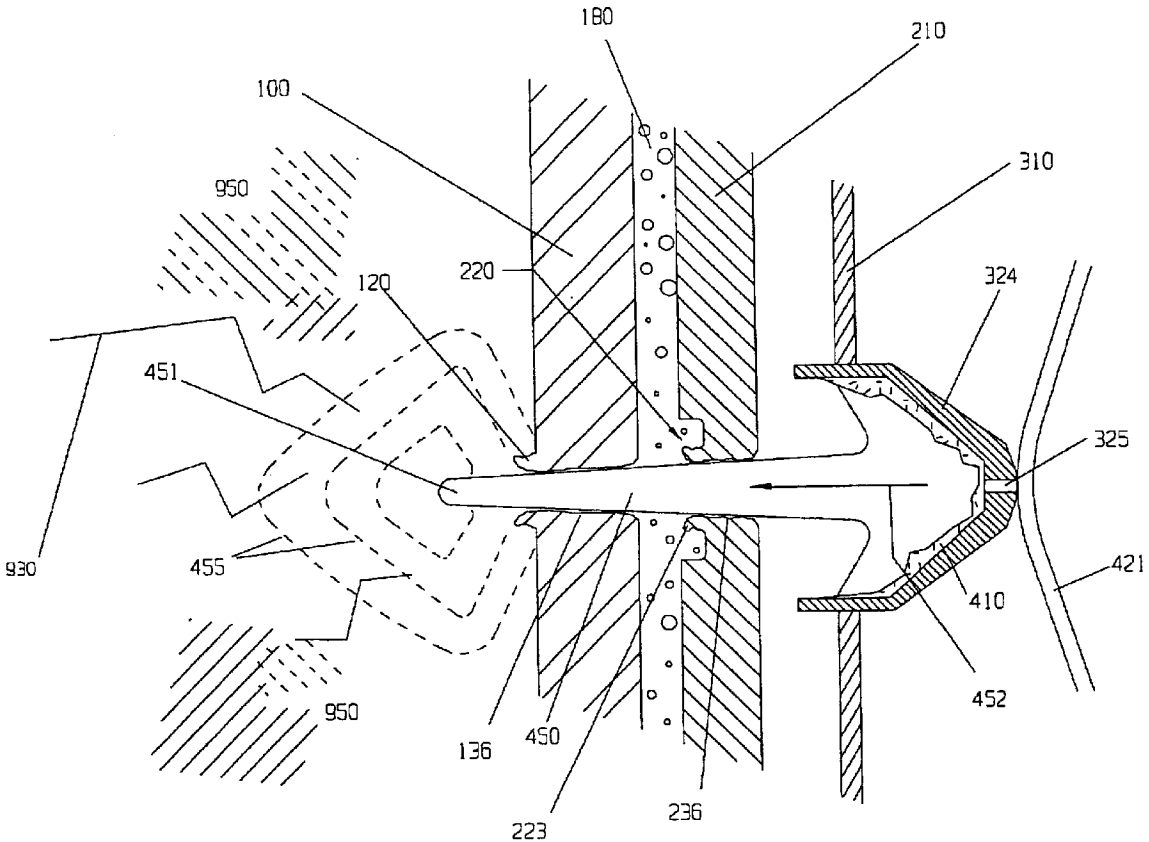
PRIOR ART FIGURE 3
FIG. 3 illustrates the detonation of the shaped charge from the loading tube penetrating through the gun wall (using existing technology) and into the geologic structure.

The high-energy explosive gas jet that is produced when a charge detonates is illustrated in FIG. 3. The duration of this explosive event is only of an extremely small fraction of a second and can be considered to be an explosive pulse occurring at detonation. During the violent and explosive energy pulse, the charge casing, loading tubes, and other gun components are subjected to an immediate, non-uniform change in pressure and temperature. The detonation cord 421 ignites the explosive 410 at the primer vent 325 within the non-combusting shaped charge body 324. The entire explosive within the charge ignites nearly instantaneously. Ignition within the shaped charge focuses an explosive jet 450 of expanding hot gas radially outward 452 toward the gun wall 210. The gun wall proximate to the short duration explosive jet or energy pulse contains a machined recess or scallop 220. The explosive jet 450 perforates 236 through the machined scalloped gun wall (having decreased thickness) and continues through the narrow space 180 between the gun wall 210 and the well casing 100. The explosive jet energy 450 also perforates 136 the well casing 100. The energy of the jet pulse 451 creates one or more shock waves 455 that fracture 930 the geologic formation 950. It will be appreciated that the amount of energy required to penetrate the gun body is reduced by the thickness provided by the scallops. The machined scallops also diminish the protrusion of burrs 223 beyond the gun wall. These burrs are created from remnants of the gun wall 210 pushed out from the outer surface as the energy pulse 450 pushes through from the interior and the shaped charge 420.

Figure 4:
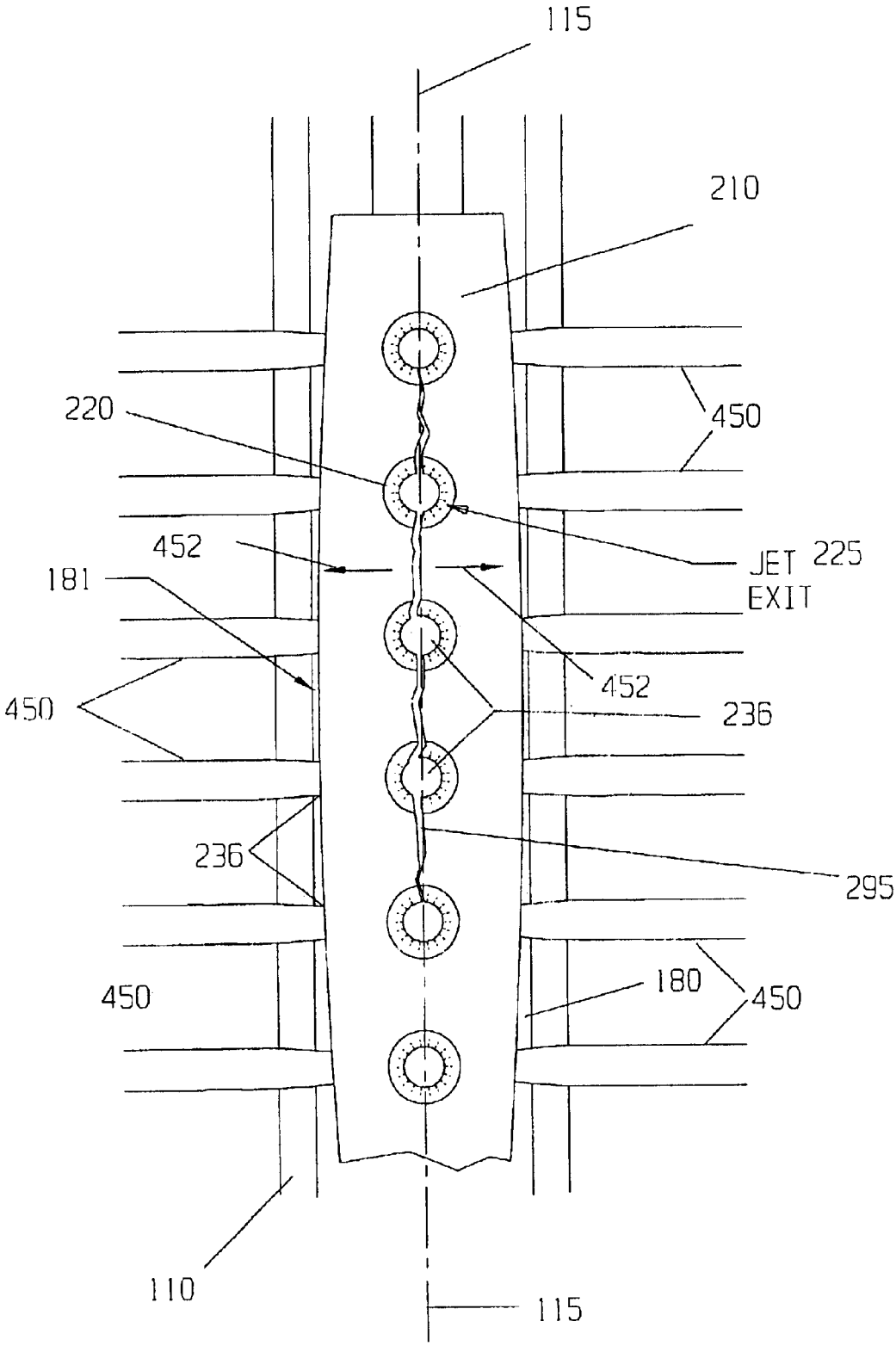
PRIOR ART FIGURE 4
FIG. 4 illustrates a typical cracking of a gun caused by use of existing technology for gun wall fabrication.

FIG. 4 illustrates a typical cracking of a failed gun experienced in the existing technology. The machined scallops 220 are fabricated weak points to facilitate the perforation of the gun wall 210 at specified locations and to retard or contain the formation of burrs (not shown) from the outer wall surface of the gun. The operation of the gun utilizes nearly simultaneous detonation of explosive charges, subjecting the separate locations of the gun wall to short, violent explosive pulses 450. The proximity of multiple scallops, designed for increased charge or shot density, can result in an unintended portion of the gun wall to fail, thereby degrading the directionality and quantity of energy reaching the well casing 110 and the geologic strata. Further, such catastrophic gun wall failure may cause the deformation of the gun preventing it from being removed from the well bore. FIG. 4 illustrates a straight-line failure in the form of the splitting or cracking 295 of the gun wall 210 and the expansion 452 of the gun wall into contact or near contact with the well casing 110. The failure can often occur due to the proximity of the scallops 220 and the resulting energy pulse exit points 236. This failure occurs simultaneously with the detonation of the explosives creating the multiple energy pulses 450 through the well casing and into the geologic formation. Although the failure may occur in orientations other than a straight line, most events occur between the machined scallops 220 and jet exit points 236 separated by the shortest distance.

FIG. 4 also illustrates the direction 452 of the gun wall or gun diameter expansion is radially outward from the longitudinal axis 115 of the gun and the well bore. This is the direction in which minimal spacing 180 between the casing and gun wall is desired. Therefore there little tolerance 181 for expansion of the gun wall or the formation of outward protruding burrs.

Figure 5A:
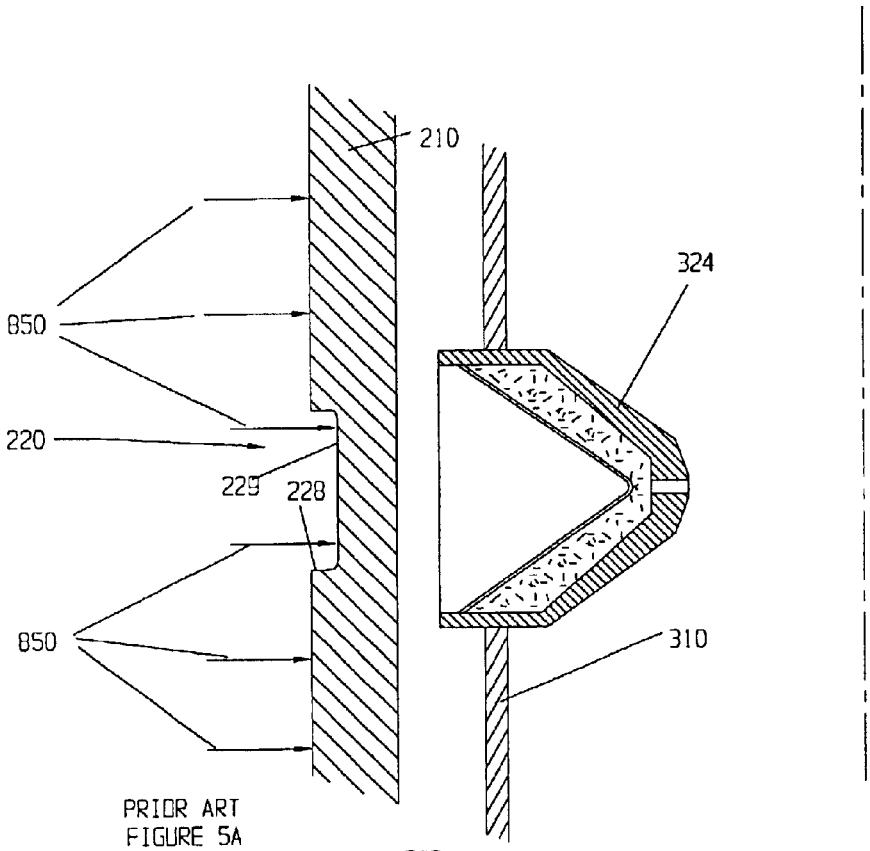
PRIOR ART FIGURE 5A
FIGS. 5A and 5B are cross-sectional depictions of the existing technology of machined scallops and the formation of burrs.
Figure 5B:
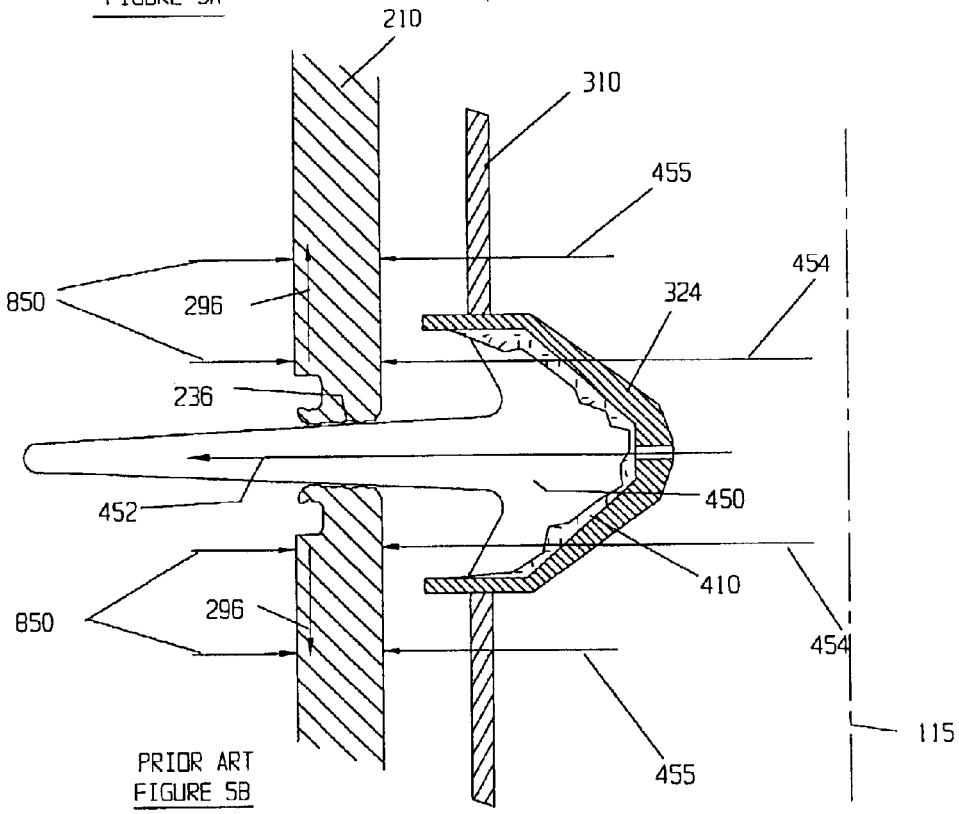
PRIOR ART FIGURE 5B

FIG. 5A illustrates that the direction 850 of static force upon the gun wall 210 caused by the increased down hole pressures. This force also applies to the bottom 229 of the machined scallop 220 where the gun wall 210 has reduced thickness. FIG. 5B illustrates the direction of energy 452 and stress sustained by the gun wall 210 during detonation. The stress is greatest near the exit point 236 of the jet 450. This increased force is represented by the respective length of the vector arrows (455 454 452). This will typically be the location and the site of any resulting material failure (such as cracking or bending), and wall failure will radiate from this point in a direction 296 through the wall 210. The failure will often start proximate to the outer wall surface and propagate radially into the wall. One limitation of the existing gun wall technology, therefore, is the number of explosive charges per foot that can be placed within a gun (shot density).

The catastrophic failure illustrated in FIG. 4 occurs in the very short nanosecond duration of the explosive pulse. Failure is not a function of the ultimate material strength of the gun wall, but rather the limited mechanical ability to transfer or absorb the shock of the high energy burst. FIG. 5A illustrates the external static load (illustrated by vector arrows 850 of uniform magnitude and placement) existing across the surface of the wall 210. FIG. 5B illustrates the non uniform and outward directed explosive force (represented by vector arrows 455 454 452 of non-uniform magnitude) occurring during the short duration of the detonation of the explosive charges. The failure occurs in this very short time period as the static load illustrated in FIG. 5A is overcome by the dynamic outward explosive force illustrated in FIG. 5B. During this short time period, there will be a dramatic dynamic shift of load forces and immediate return or near return to the original load force. The impact strength of the gun wall, that is its ability to withstand the immediate dynamic shift in load, may be a factor independent of the ultimate load (tensile) strength of the gun wall. FIGS. 5A and 5B also illustrate the orientation of the static force 850 and explosive jet 450 and force 455 454 452 to the loading tube wall 310, the charge 324 and the longitudinal axis 115. FIG. 5A illustrates the bottom 229 and side wall 228 of the machined recess. FIG. 5B also illustrates the jet 450 exit 236 through the gun wall and vectors 296 showing dispersion of energy though the wall.

Figure 6:
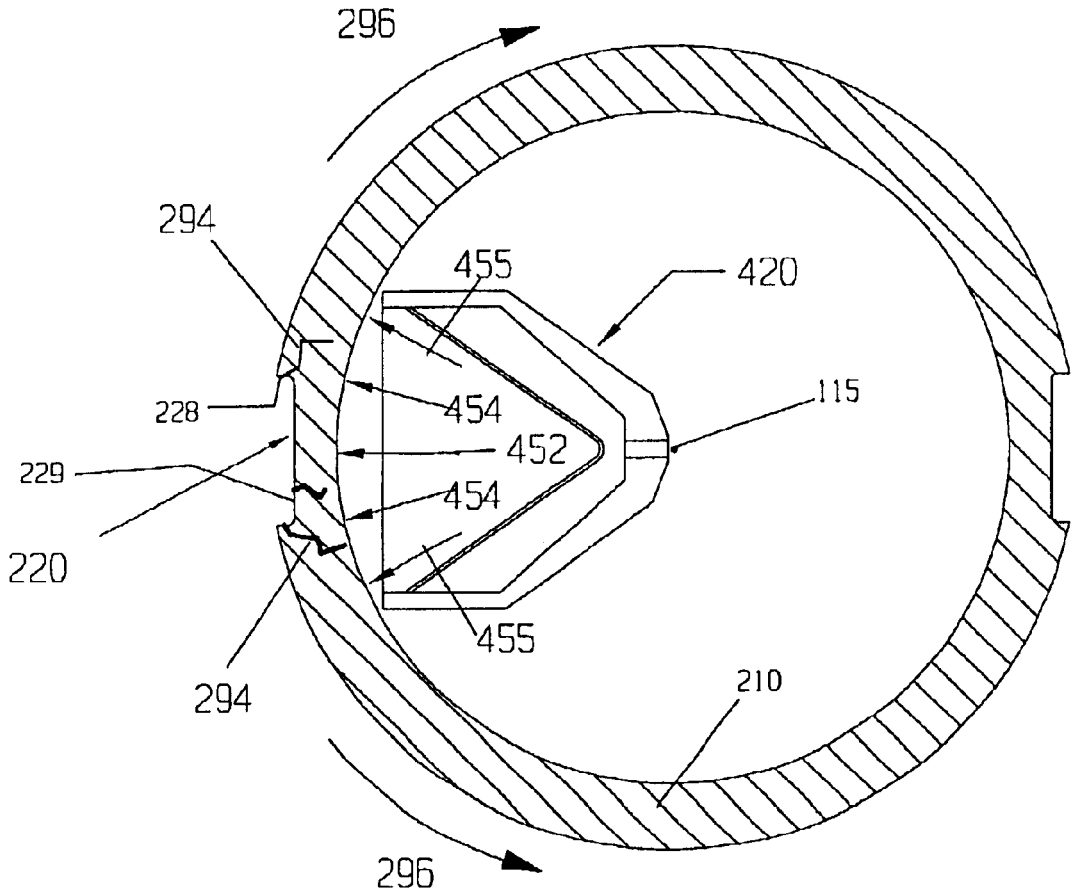
PRIOR ART FIGURE 6
FIG. 6 is a cross-sectional depiction of a gun wall that shows how existing technology can contribute to gun wall cracks.

FIG. 6 is a cross sectional view of the gun wall 210 illustrated in FIG. 5B. For clarity, the loading tube is not shown. The machined scallop 220 on the outer surface of the wall will be the location of the exit point of the explosive jet energy pulse (not shown). The orientation of the scallop and the shaped charge 420 is shown. Cracks or defects 294 propagating in the gun wall 210 proximate to the scallop due to the impact of the explosive energy pulse are shown. As in FIG. 5B, the non uniform and outward directed explosive force occurring during the short duration of the detonation of the explosive charges is represented by vector arrows 455 454 452 of non-uniform magnitude. The cracks (wall failure) 294 normally occur in conventional guns at the machined scalloped recess edges or wall 228 or the scallop bottom surface 229 proximate to the jet exit point. The cracks typically initiate from the outside diameter of the gun wall and propagate in a traverse direction 296 through the wall and radially into the wall. Since the internal loading is maximized at the machined scalloped location 220, being the intended jet exit point, and dissipates as it travels away from the scallop, there is a tendency or frequency of the multiple crack failures propagating from separate scallop locations to linkup to produce a zipper effect along the line of charge locations. FIG. 4 illustrates this type of catastrophic failure 295.

The design criteria specified by the invention can be used to create an alternative gun tube construction that eliminates many of the problems and costs of the heavy walled tubing currently used. Although multiple embodiments of new gun material selection and construction are within the scope of this invention, attention should be first directed to the design and fabrication of gun tubing utilizing multiple layers of material. This method includes fabrication by layering or lamination of materials around a radius encompassing the longitudinal axis of the gun tube.

Figure 7:
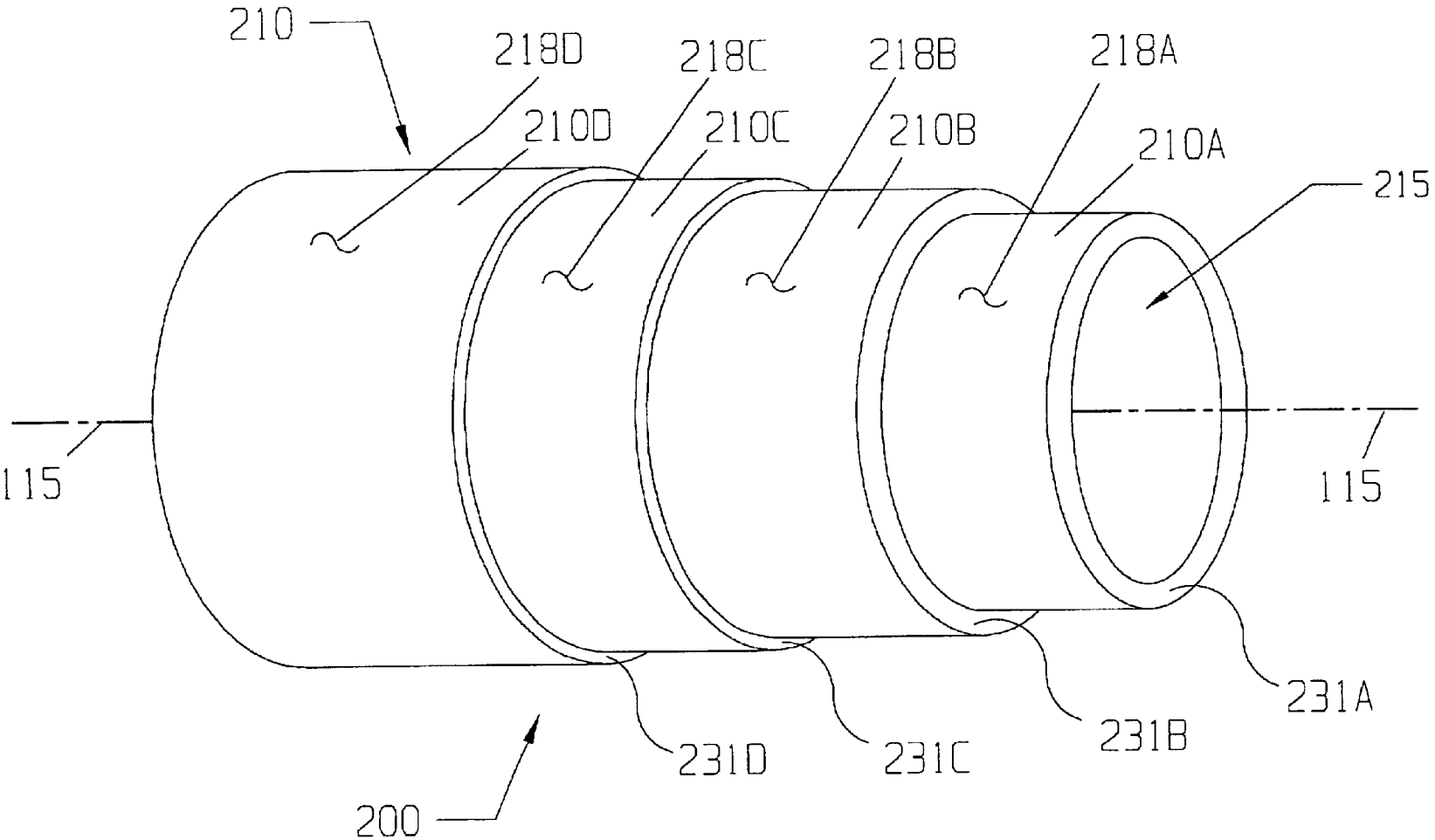
FIG. 7 illustrates an embodiment of the invention comprised of an engineered sequence of layered materials.

FIG. 7 illustrates the construction of a gun wall 210 comprised of four material layers (210A 210B 210C 210D). The orientation of each layer is parallel or at a constant radius to the longitudinal axis 115 of the gun (200) and the well bore (not shown). The thickness of each layer or tube 231D 231C 231B 231A may be varied. The diameter of the annulus 215 formed within the inner tube may also be varied. The outer surface of each respective tube layer may be varied in construction to facilitate binding and retard delamination. Such designs may facilitate the strength characteristics of the gun wall in alternate directions, such as traverse or longitudinal directions. It is known that multi-layered constructions can have numerous advantageous over conventional, monolithic material constructions. It will be appreciated that this invention does not limit the number of layers, the composition of individual layers, or the manner in which layers are assembled or constructed. Further, the invention is not limited to the use of a binder or laminating agent between material layers; for example the outer surface 218A on the inner most layer 210A and the inner surface of the next outer layer (not shown).

It will be appreciated that lamination of multiple layers of the same or differing materials may be used to enhance the performance over a single layer of material without increasing thickness. Use of fibrous materials, such as high strength carbon, graphite, silica based fibers and coated fibers are included within the scope of this invention. Although some embodiments may utilize one or more binding elements between one or more layers of material, the invention is not limited to the use of such binders. Plywood is an example of enhancing material properties by layering wood to produce a material that is superior to a solid wood board of equal thickness. Applications of multi-layered lamination can be subdivided into primary and complex designs. Additional embodiments of the invention are described below.

Figure 8:
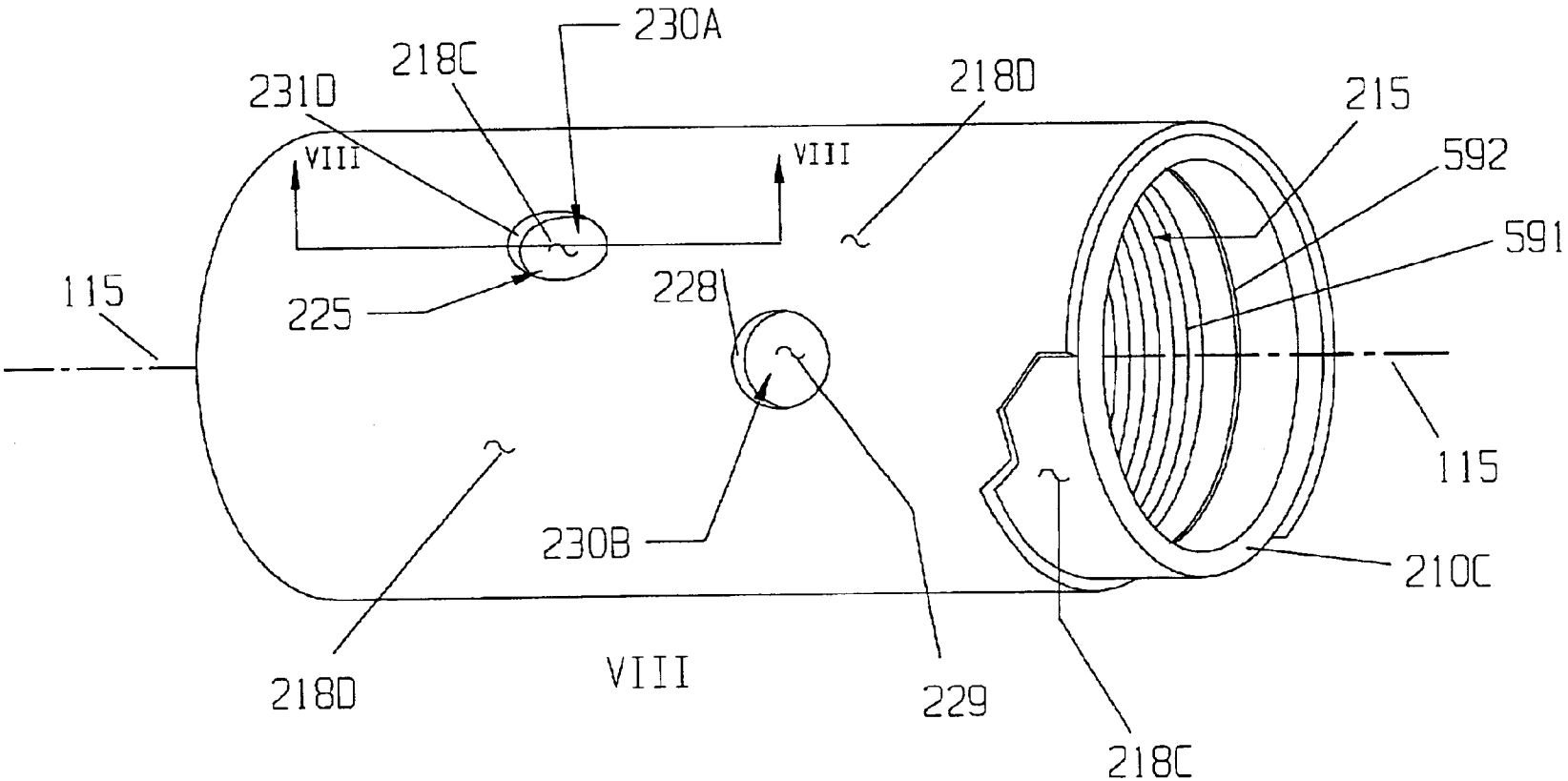
FIG. 8 illustrates an embodiment of the invention showing use of perforated tubing, thereby eliminating machining of scallops.
Figure 8A:
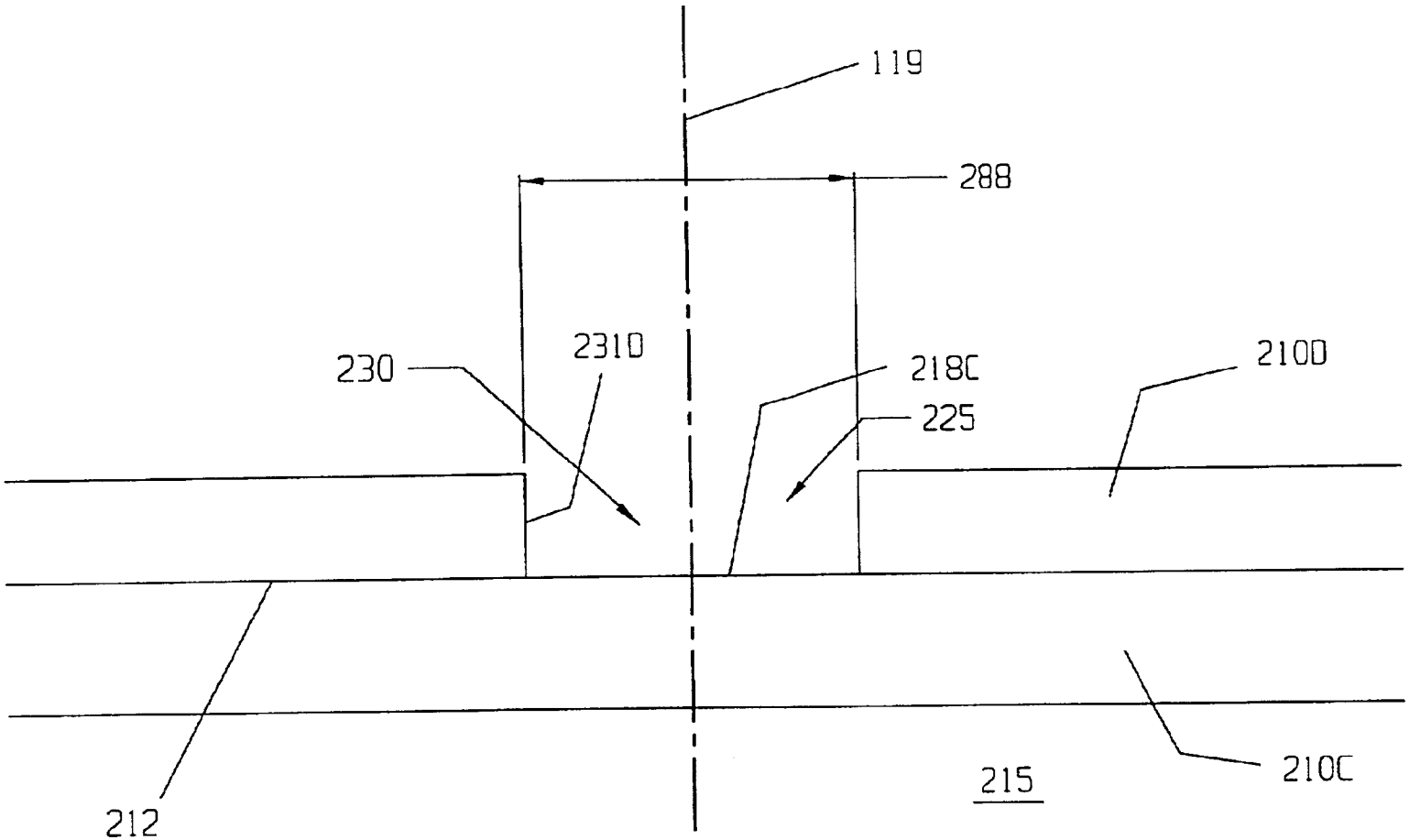
FIG. 8A illustrates a cross section view of the layered wall construction.

FIG. 8 illustrates the primary "tube-within-a-tube" design, similar to the embodiment of the invention illustrated in FIG. 7 and having a longitudinal axis 115. The outer layer 210D is a cylinder or tube in which holes 230A 230B have been cut through the thickness of the cylinder wall 231D. The diameter of the outer cylinder 210D is approximately equal to the outer diameter of the next inner cylinder 210C. In the embodiment illustrated in FIG. 8, there are no holes cut through the walls of the next inner cylinder 210C. Therefore, the combined cylinder, comprising the "tube within a tube" of 210D and 210C, has the approximate physical shape of the prior art single walled gun having recesses or scallops machined into the outer surface of the wall. In a preferred embodiment of the invention, holes 230A 230B are cut through the outer cylinder wall 210D prior to assembly of the two cylinders 210C and 210D. The line VIII—VIII designates the location of the cross sectional view illustrated in FIG. 8A. FIG. 8A shows a portion of the inner cylinder wall 210C and its relationship with the outer wall 210D and annulus 215. The illustration does not; however depict the radial curvature of each layer. The diameter of the hole 288 may be varied. The axis 119 of the resulting hole 230 may be orthogonal to the longitudinal axis (115 of FIG. 8). It will be appreciated that the resulting recess 225 depicted in 8A is comparable to the recess or scallop 220 machined into the gun wall 210 illustrated in FIG. 2A. In the structure of the invention shown in FIG. 8A, the thickness 231D of outer cylinder wall 230D forms the side wall (228 in FIG. 8) of the recess 225. The outer surface 218C of the next inner cylinder 230C forms the bottom (229 in FIG. 8) of the recess or scallop 225.

It will be readily appreciated that the composition of the several layers or cylinders might differ. Also the thickness and number of layers might be varied, depending upon the requirements of the specific application. The cutting of holes can be accomplished before assembly, thereby eliminating the need for machining.

FIG. 8 also illustrates the ability to perform machining or other fabrication on the individual cylinder components prior to assembly into the completed unit. For example, machining of connector structures can be performed on the inner cylinders individually prior to being inserted or pulled into the larger cylinders. These structural components may be machined threads, seal bores, etc. FIG. 8 illustrates a design that incorporates a machined connection end components 591 592 on the innermost tube 210C of a multi-layer tube construction.

As discussed above, it is not necessary that the interface (212 in FIG. 8A) of the surfaces of the inner and outer of tubes or cylinders be bound or otherwise mechanically attached together. An advantage to this design is its simplicity and ease of manufacture. Each of the tubes may have different chemical and mechanical characteristics, depending on the performance needs of the perforation work. Alternatively, each tube can be made of the same material. In another variation, layers of tubing can be made of the same material but oriented differently to achieve the desired properties (similar to the mutually orthogonal layering of plywood). One further variation can be implemented by offsetting a seam of each cylinder or tube layer created in the manufacturing process by rolling flat material into a tube.

One variation of the embodiment illustrated in FIG. 8 might include an inner tube of high-strength material (such as the high-strength, alloy metals currently used for guns) and an outer tube of mild steel.

Figure 9:
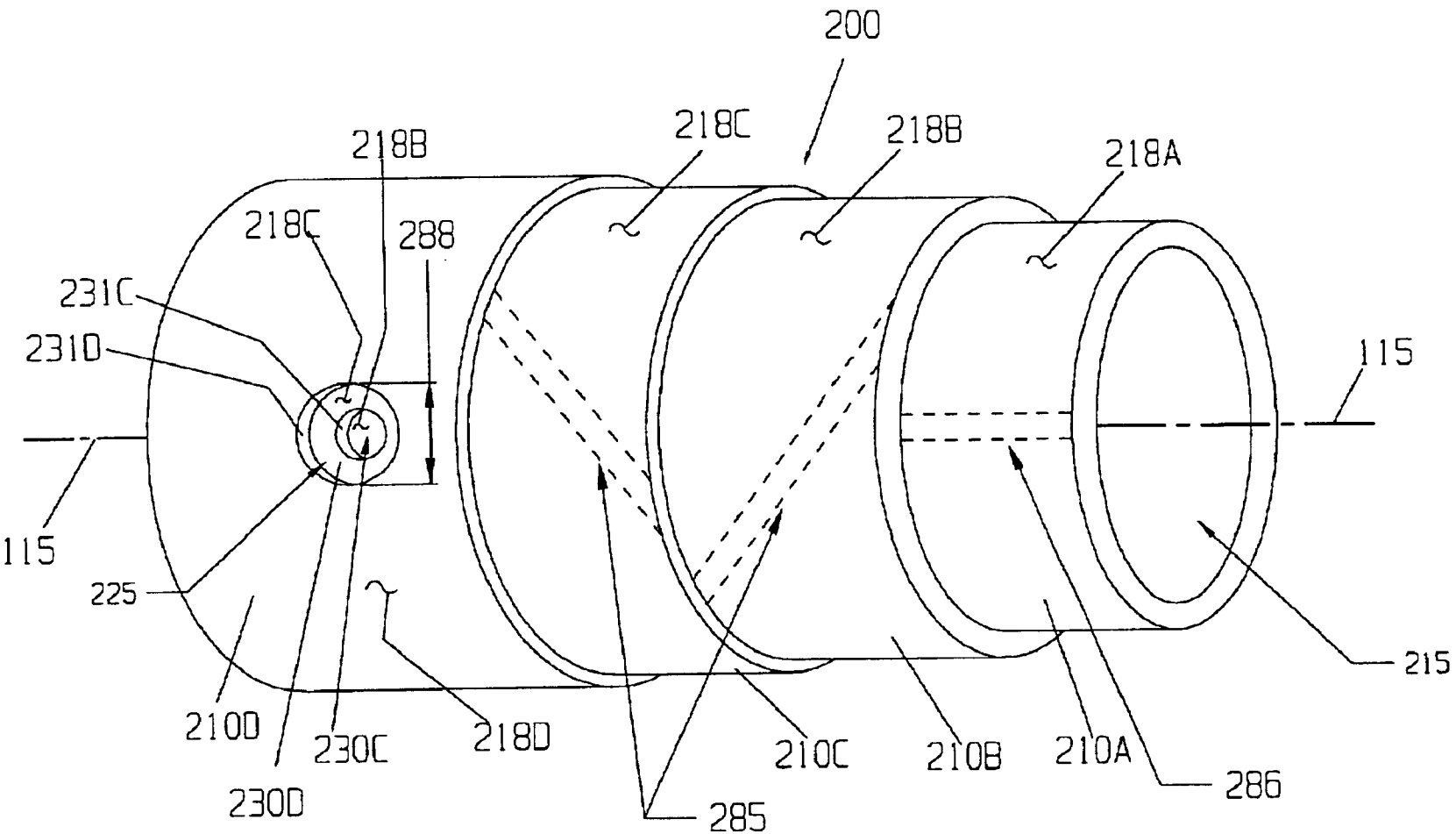
FIG. 9 illustrates a detailed embodiment of the invention employing laminates for extra strength.

FIG. 9 illustrates an embodiment of the invention in which the gun has four material layers (210D 210C 210B 210A). The invention, however, is not limited to four layers. The multi-layer design might consist of tube-in-a-tube fabrication or the wrapping of material around the outer surface of an inner tube maintaining a relative uniform radius about a central axis 115. The inner tube defines the area of the tube annulus 215. The tubing layers may be seamless or rolled. It will be readily appreciated that layering material can be wrapped in various orientations 285 286 to provide enhanced strength. Two layers 210C and 210B are shown helically wrapped 285 at a radius around the longitudinal axis 115. The next inner layer 210A is shown comprised a rolled tube having a seam parallel to the longitudinal axis. It will also be appreciated that the wrapping might include braiding or similar woven construction of material. FIG. 9 also illustrates that any given layer 210C 210B might consist of a material "tape" wrapped around an inner tube or cylinder 210A. The inner most layer 210A may also be formed around a removable mandrel (not shown). The laminations can consist of other metals or non-metals to obtain desirable characteristics. For example, aluminum is a good energy absorber, as is magnesium or lead. This invention does not limit the material choices for the lamination layers or the manufacturing method in obtaining a layer; it specifies only that layers exist and provide advantages over single-wall, monolithic gun designs.

Also illustrated in FIG. 9 are one or more layers 210D 210C containing holes 230D 230C having diameters cut prior to assembly. The hole 230D cut into the outer tube 210D has a diameter 288. The axis of the holes can be orthogonal to the longitudinal axis 115 of the gun 200. The tube layer thickness 231D 231C of the cut 230D 230C forms the wall of the recess 225 and the outer surface 218B of the next underlying layer 210B forms the bottom of the recess 225. The architecture of the resulting recess is comparable, but advantageous to, the prior art machined scallops.

Wrapping designs and fabrication techniques allow far greater numbers of metals and non-metallic materials to be used as lamination layers, thereby achieving cost savings and reducing production and fabrication times. Improved rupture protection can be achieved without increasing the weight or cost. FIGS. 9 and 9A illustrate two examples of this embodiment.

FIG. 9A illustrates how a perforated or non-continuous material can produce a lamination layer, even though voids may exist within that layer. The layers might consist of continuous sheets with regular perforations, woven sheets of wire, bonded composites, etc. An energy absorption layer 210C contains numerous perforations 226 each having small diameter 289. In another embodiment, not shown, the voids might contain material contributing to material strength at ambient temperature and pressure, but that is readily vaporized by the explosive high-temperature and high-pressure energy pulse, thereby providing minimal energy impedance proximate to the explosive charge, recess and well casing, but maximum shock absorption in other portions of the gun not immediately subjected to the directed high temperature explosive gas jet.

The energy absorption layer 210C illustrated in FIG. 9A has mechanical properties permitting the inner layers 210B 210A to expand into the volume occupied by the absorption layer in response to the high impact outward traveling explosive energy pulse occurring upon charge detonation. This mechanical action will consume energy that might otherwise contribute to a catastrophic failure of the outer layer 210D. As already discussed, such failure can hinder the intended perforation of the well casing and the surrounding geologic formation (not shown) or hinder the removal of the gun from the well. These mechanical property enhancements allow higher strength, thinner wall perforating guns with high impact resistance and energy absorption.

In addition to the specific energy absorbing layer shown in FIG. 9A, it will be appreciated that each layer could provide strength or other properties specifically selected by the design engineer to meet conditions of an individual well bore. Therefore, this invention allows wall thickness and composition to become design variables without needing mill runs or large quantities of material.

FIG. 9A also illustrates a recess 225 in the gun wall 210 fabricated from hole 230D cut through selected layers 210D prior to assembly of the combined tubes. The outer surface 218C forms the bottom of the precut recess 230D.

Figure 9B:
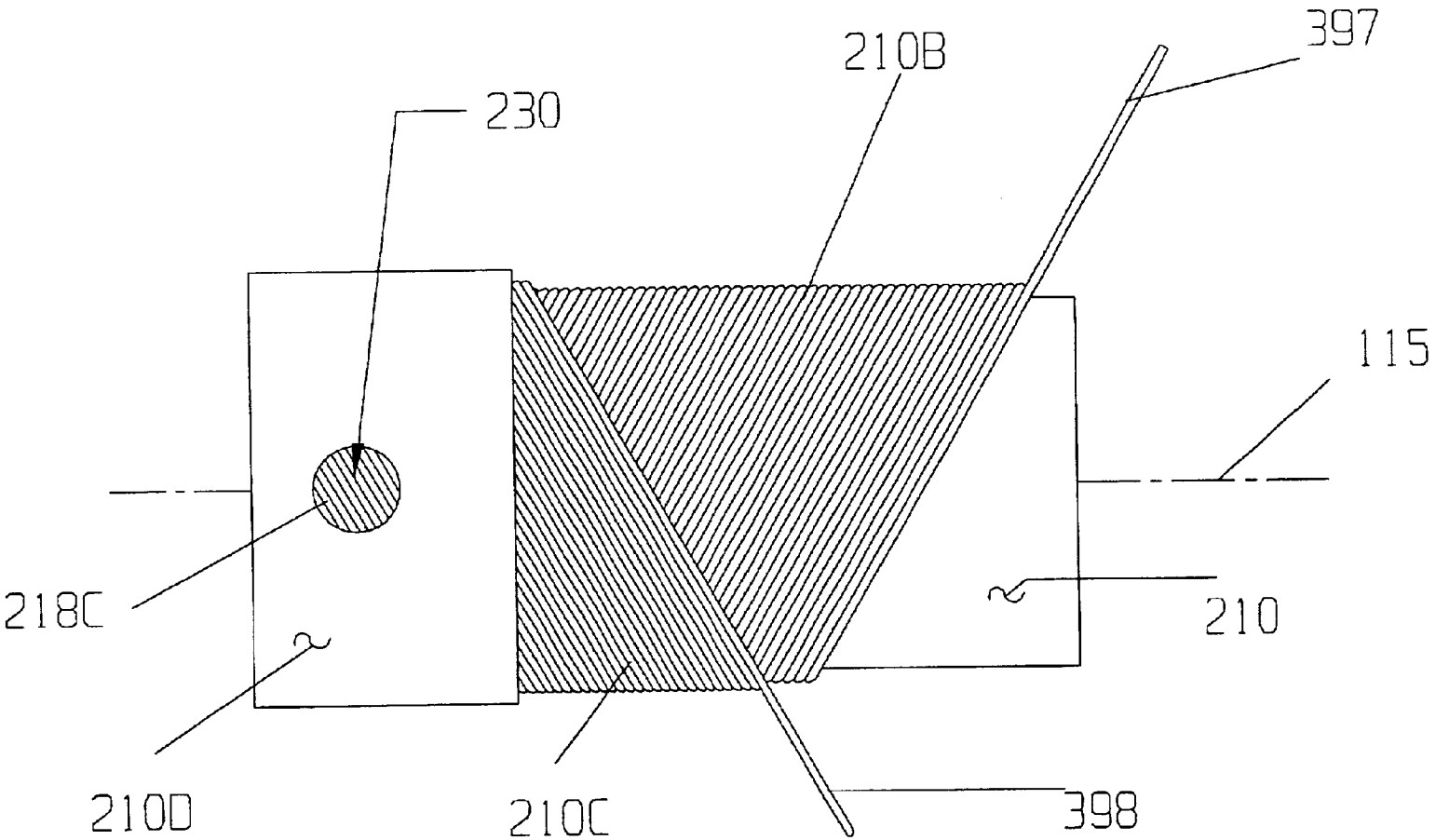
FIG. 9B illustrates an embodiment of the invention utilizing precut holes and wrapped layers.

FIG. 9B illustrates an embodiment using helically wound fiber or wire 397 398 around an inner layer 210A. The wrapping can also be performed utilizing a removable mandrel. The wrapped layers 210B 210C can be combined with tubes or cylindrical layers 210A 210D. The tube layers can incorporate precut holes 230. In the embodiment illustrated in FIG. 9B, the outer surface 218C of layer 210C is exposed by the precut hole 230 in the outer layer 210D. The winding may be performed prior to placement of the next outer layer. The fiber or wire can be high strength, high modulus material. This material can provide strength against the explosive pulse. The diameter of fiber or thickness of wrapping can be varied for specific job requirements. The geometry of the winding (or braiding) can be varied, particularly in regard to the orientation to the longitudinal axis 115.

FIG. 10 illustrates a complex gun 200 formed from multiple layers or tubes radially aligned around a longitudinal axis 115. The wall 210 of the gun 200 forms a housing around an annulus 215. The explosive charges, detonator cord, and carrier tube can be placed within this annulus 215. Also illustrated is a recess 225 formed in the manner described previously. The center axis 119 of the illustrated recess 225 is orthogonally oriented 910 to center axis of the gun 115. FIG. 10A illustrates an embodiment of the invention wherein the outer three layers 210D 210C 210B of the gun wall 210 contain holes cut prior to assembly of the tubes into a single cylinder. Although the diameter 288D 288C 288B of each hole is different, the center axis 119 of the combined holes 230 are aligned. The inner layer 210A is not cut, and the outer surface 218A of that tube forms the bottom 229 of the resulting recess 225. The thickness of each precut layer creates a stepped wall 228 of the recess. An explosive charge as depicted in FIG. 2A may be installed proximate to the inner surface of the innermost layer 210A and aligned with the recess center axis 119. FIG. 10B illustrates another embodiment wherein the inner tube layer 210A is cut through prior to assembly, a next outer layer 210B is not cut at the location, but the next outermost layers 210C 210D are cut through and the center axes of the precut holes are aligned 119. This architecture achieves an inner recess 226 within the gun wall 210 aligned with an outer recess 225. This architecture or structure can be readily achieved by this invention. This structure cannot be practically achieved by the prior technology.

FIG. 10C illustrates another embodiment readily achieved by the invention, but that is not practicable by prior technology. It will be appreciated that the shape of the interior recess 226 can be varied in the same manner as the outer recesses may be formed. Accordingly, the recess diameter can be varied within the interior of the gun wall 210.

FIG. 10D illustrates a structure that has not been possible prior to the invention. The gun wall 210 can contain an interior recess or cavity 235. The radial axis 119 of the cavity can be aligned with an explosive charge as illustrated in FIGS. 2A and 6. At the time of assembly, the cavity may be filled with a eutectic material or other material selected to provide strength at ambient conditions but disperse, vaporize or otherwise degrade with the rapid explosive energy pulse. FIG. 10E illustrates a combination interior recess 236 with an internal cavity 235. The interior recess diameter 288A and the internal cavity diameter 288C may be varied as selected by the gun designer.

It will be readily appreciated that the dimensions of each precut hole can be specified. This ability can achieve recesses within multiple layers that, when assembled into the composite gun, the recess walls may possess a desired geometry that may enhance the efficiency of the explosive charge or otherwise impact the directionality of the charge. Further, it will be appreciated that interior recesses may be filled with materials that, when subjected to high temperature, rapidly vaporize or undergo a chemical reaction enhancing or contributing to the original energy pulse.

Figure 10F:
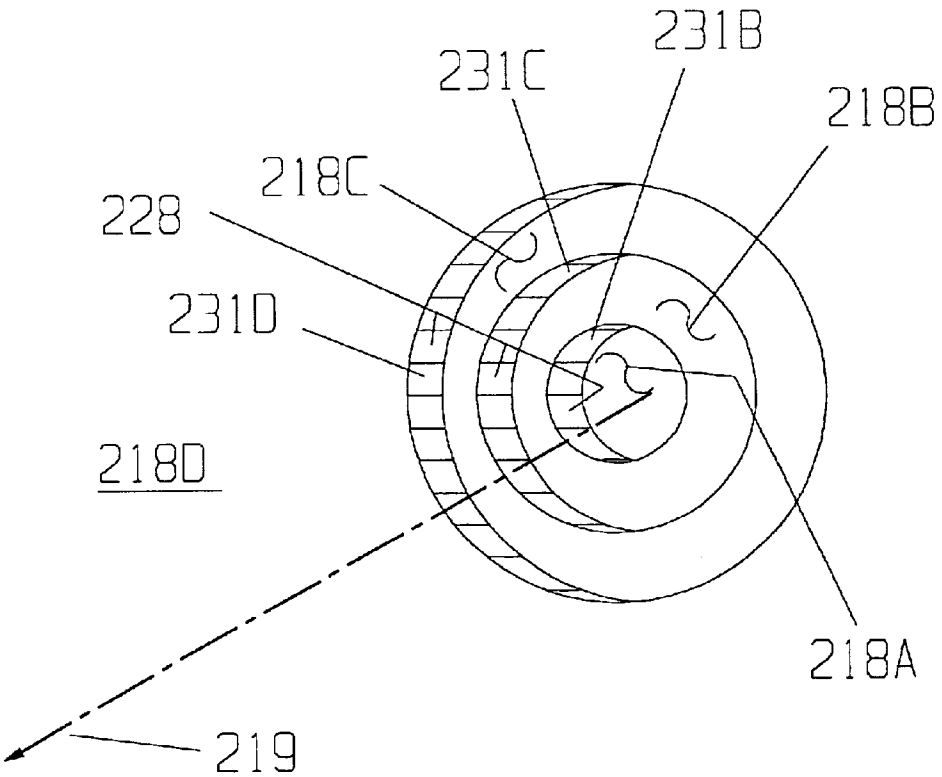

FIG. 10F is a detail of a complex recess 225 comprised of precut holes of varying diameters and aligned in relationship to the same radial axis 119. It will be appreciated that the illustrated recess may comprise part of an internal wall cavity (similar to that depicted in FIG. 10D) or a recess on the interior gun wall (similar to that depicted in FIG. 10C). It will be appreciated that the recess illustrated in FIG. 10F contains stepped walls 228 231B 231C 231D having increasing diameter outward along the axis 219. The outer gun wall is comprised of the surface 218D of the outer layer 210D. The bottom of the recess is formed by the outer surface 218A of inner layer 210A.

Figure 11:
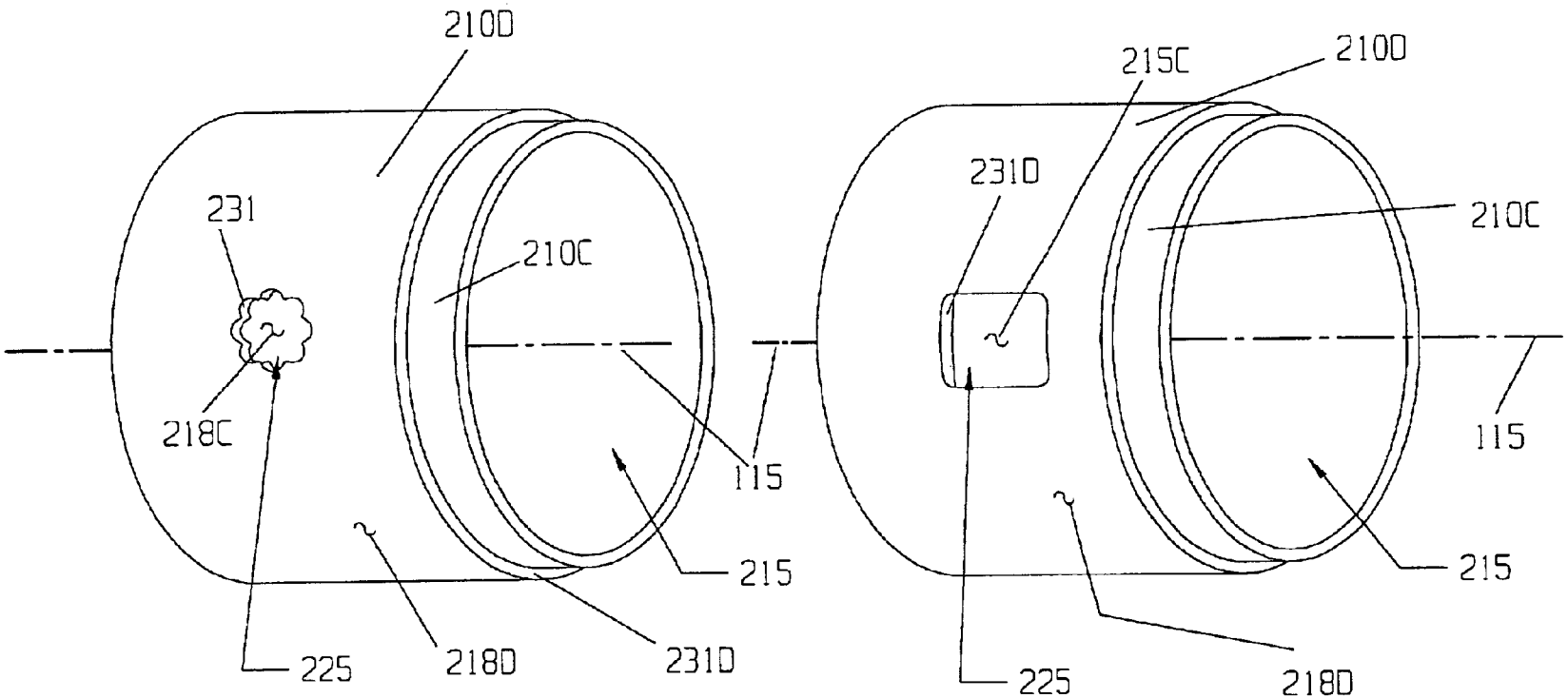
FIG. 11 illustrates alternate designs for precut recesses of the invention.

FIG. 11 illustrates precut holes forming recesses 225 in the outer layer 210D of the multi-layered gun wall (210D 210C) having predefined complex outside wall shapes alternative to the circular shaped precut hole. The layer thickness 231D and surface 218D 218C as well as the annulus 215 and longitudinal axis 115 are also shown. Actual shape design is unlimited since design is no longer restricted by conventional machining methods. Any combination between layers (such as the example shown in FIGS. 10, 10A thru 10F) and any shape (such as the example shown in FIG. 11) can be easily produced by laser cutting, tube assembly or layer lamination, and any required material wrapping.

Figure 12:
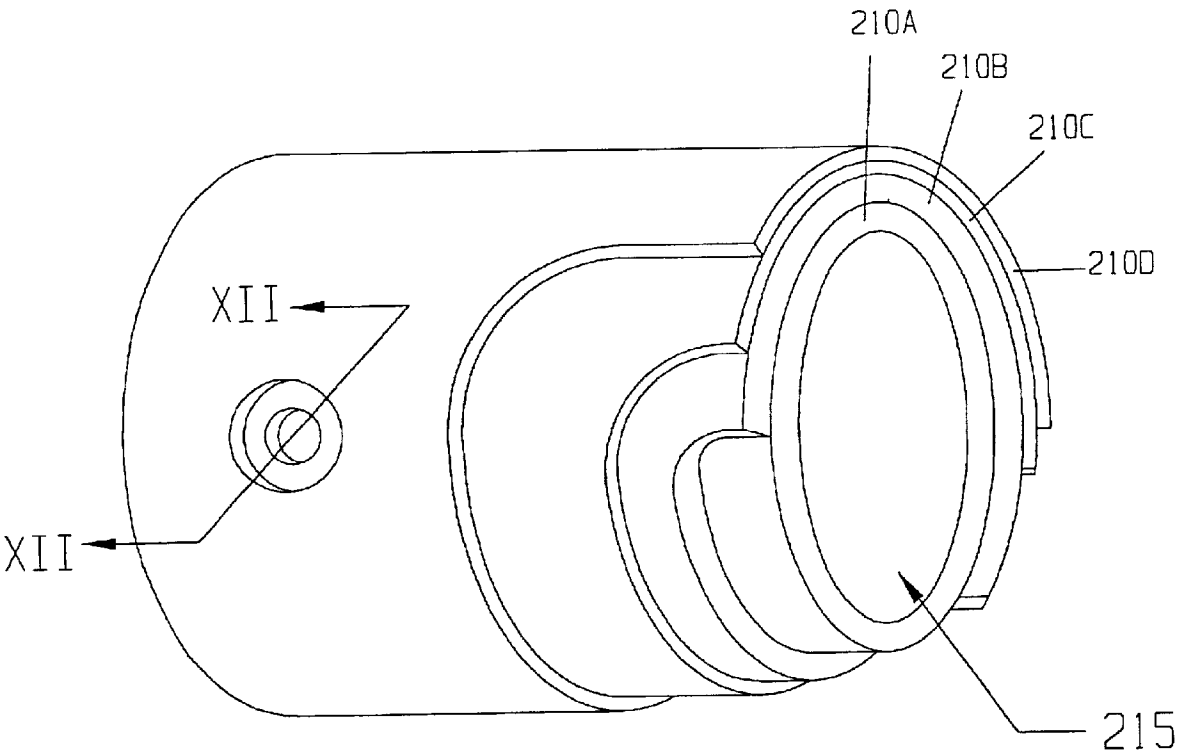
FIG. 12 illustrates a further embodiment of the invention.
Figure 12B:
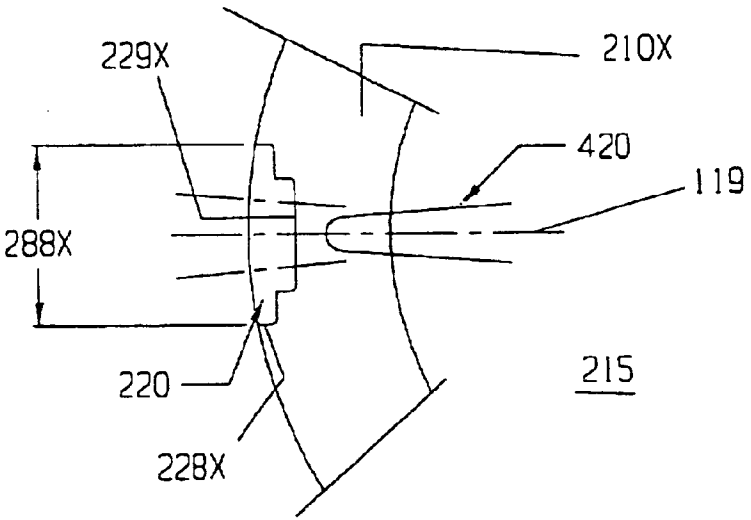
PRIOR ART FIGURE 12B
FIG. 12B depicts a side sectional view of the prior art machined scallop.

An additional advantage of the invention is fewer "off-center" shot problems and better charge performance due to scallop wall orientation (comparing FIGS. 12A and 12B) since the outer tube's recess 229 can achieve a constant underlying wall thickness 210B regardless of the explosive jet 420 exit point. In comparison, FIG. 12B illustrates the prior art machined scallop 220 having a constant diameter 288X. The bottom of the scallop 229X is flat and of non uniform thickness. It will be appreciated that if the explosive pulse of the detonated charge is not oriented perpendicular to the outside gun wall, the brief explosive jet pulse will encounter a non uniform gun wall, thereby creating a disruption or turbulence in the flow with resulting dissipation of energy. The invention subject of this disclosure results in a uniform wall thickness, thereby minimizing energy dissipation.

Figure 12A:
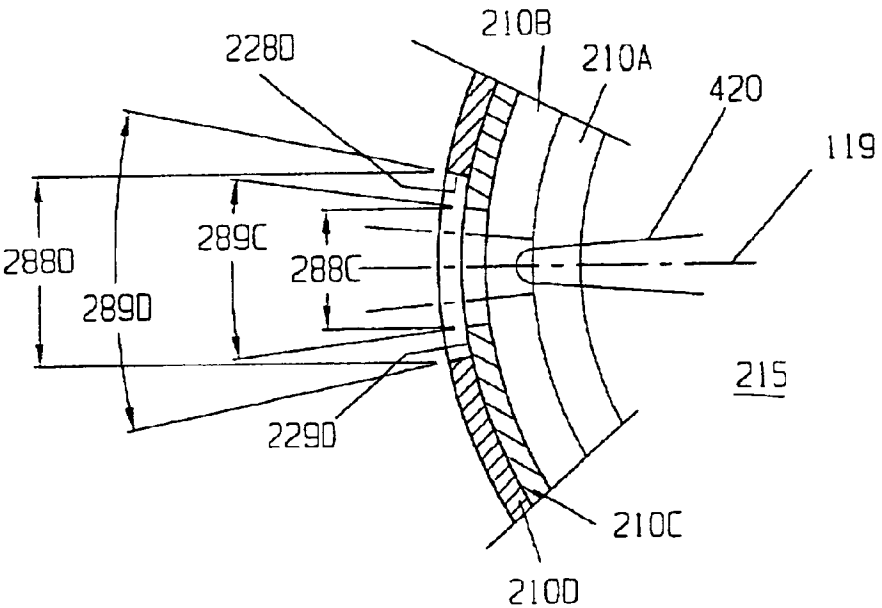
FIG. 12A depicts a side sectional view of the invention depicted in FIG. 12 an improved scallop configuration using a multi-layered gun tube.

FIG. 12A illustrates the constant angle 289D 289C of the recess side wall 228D 288C oriented to the centerline 119 achieved by this invention. Unlike the prior art technology of milling scallops into solid monolithic tube wall, the radial orientation of the recess side wall formed by the invention can be maintained constant to a point on the longitudinal axis. The cut hole results in a removal of an arc segment 289D 289C from the circumference of the cylinder or tube wall 210D 210C. The angle can be varied by the length of the arc segment 289D 289C cut relative to the diameter of the tube layer (or radial distance from the center axis of the gun). It will be appreciated by persons skilled in the technology that the angle can facilitate the accuracy or efficiency of the explosive charge. This angle may minimize interference or disruption of the explosive gas jet 420 through the gun toward the casing and strata. The prior art scallops generally have a fixed orientation to the center axis of the scallop 119. However, this fixed dimension creates a non uniform orientation to the center axis of the gun (not shown) or the explosive charge positioned within the annulus 215 and proximate to the center axis. (See FIG. 2A and FIG. 6.)

Figure 12C:
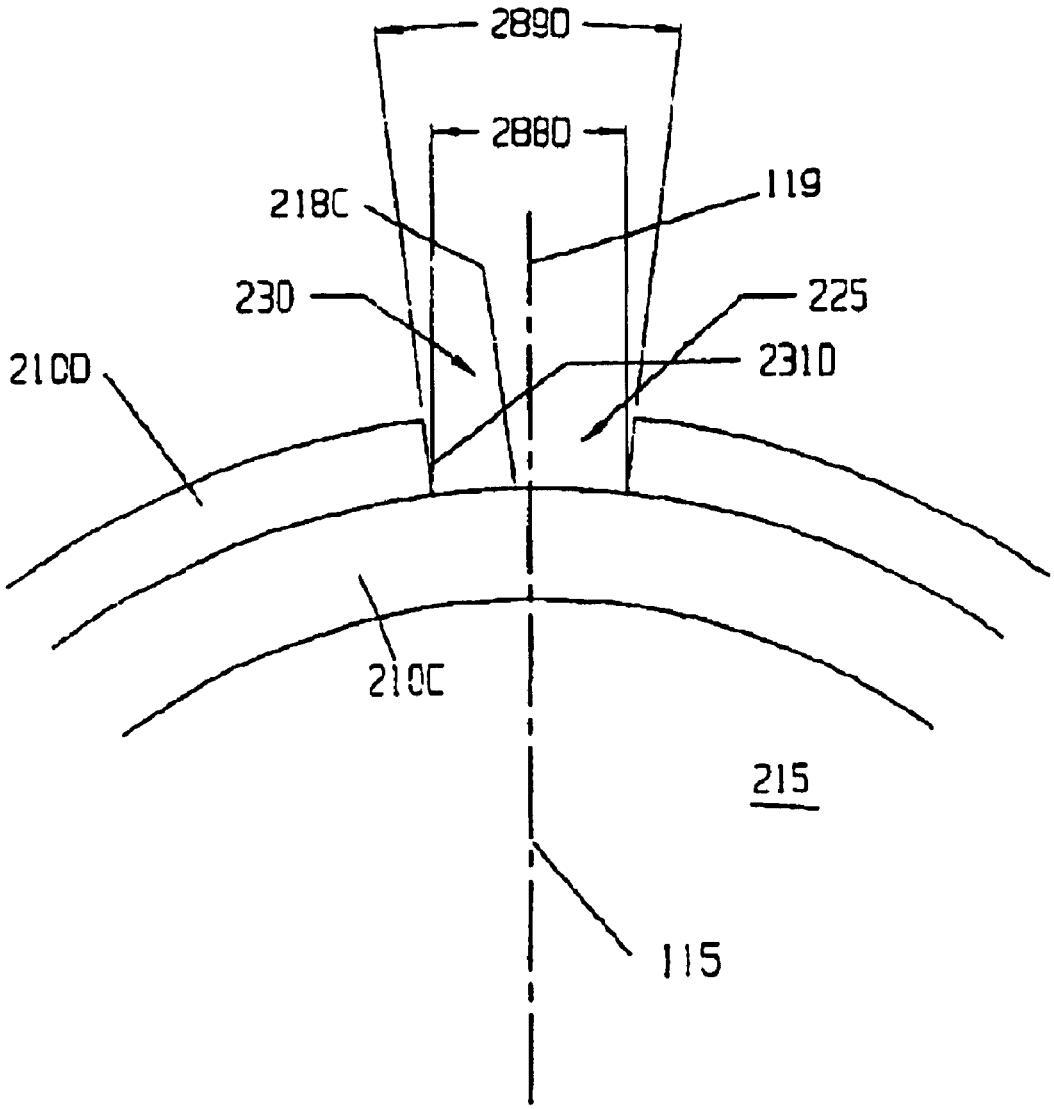
FIG. 12C further illustrates recesses with the walls of perforating guns subject of the invention.

FIG. 12C illustrates the gun wall recess 225 of the present invention may also achieve variable side wall angles θ 289D. The relationship of the precut hole diameter 288D to the side wall angle and to the center axis 115 of the gun, as well as the annulus 215 is also shown. The curvature of the bottom surface 218C of the recess 225 is also illustrated.

Figure 13A:
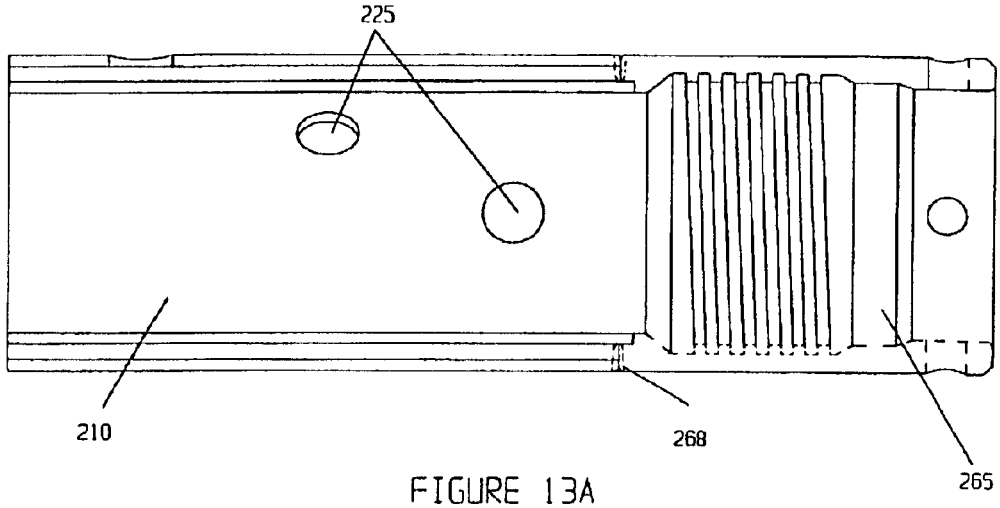
FIG. 13A illustrates a detailed embodiment of the invention.
Figure 13B:
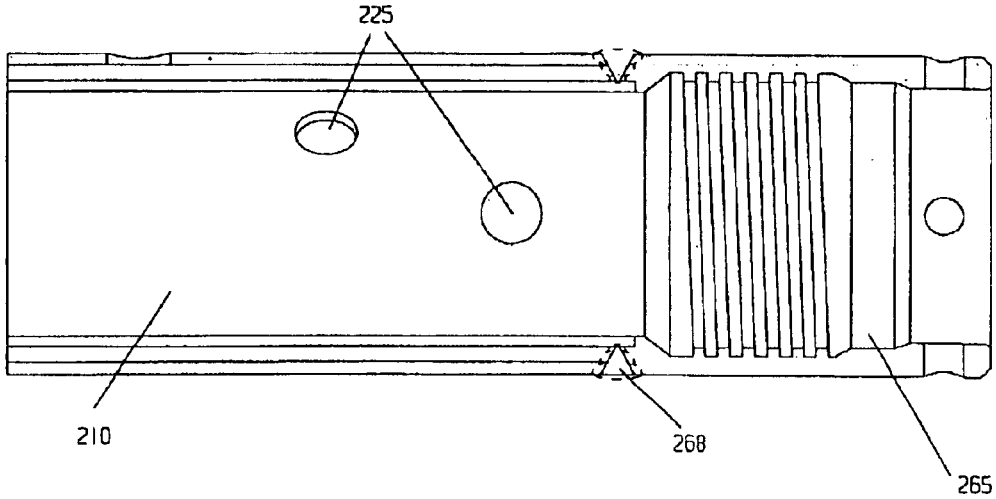
FIG. 13B illustrates the size of holes achieved by conventional well technology.

FIG. 13A illustrates a weld seam 268 connecting components 265 to multiple layers of a gun wall 210 requiring less machining. This weld can be performed by laser welding, similar to techniques available for the precutting of holes 225 within the gun wall 210. The weld seam 268 illustrated in FIG. 13B depicts the size achieved by conventional well technology.

In some embodiments, it may be advantageous to weld or mechanically attach machine threaded connection ends to at least one tube layer. FIG. 13 illustrates use of laser welding gun connection fittings for designs utilizing multiple layers. Laser welding involves a low-heat input process, thereby allowing completed machined connection end turnings to be welded directly. Conventional multi-pass welds may require machining after welding to eliminate the effects of distortion.

Other advantages of the invention include more choices of tube supply, especially domestic supplies with far shorter lead times. Lower manufacturing costs are achieved by laser cutting scallops in the outer lamination instead of machining solid, heavy-walled tubes, which is the practice of current technology.

Specific benefits from the construction of guns utilizing multi-layering of differing materials and material orientations as specified by this invention include, but are not limited to lower material costs, reduction of material weight and thickness, decreased dependence upon expensive high strength materials having long lead-time production requirements, and greater flexibility in gun designs including tailoring the properties of the gun wall to accommodate varying field conditions to achieve enhanced performance. In addition, better gun performance is achieved by precut tube scallops having uniform thickness, increased flexibility to create modified scallop walls and shapes, and increased impulse shock absorption by the multiple tube layer interface. Also an inner tube can have higher strength without the adverse effects of brittleness since an outer ductile layer may contain the inner tube.

Since recesses (scallops) can be cut individually into each tube layer before being assembled into a gun tube, many different recess designs are available. One benefit of this recess capability is to produce internal and inner diameter (inner wall) recesses that would be virtually impossible to produce in conventional gun manufacture. It is not the intent of this invention to specifically describe the benefits of all recess designs, but rather to indicate that the advantages will be apparent to persons skilled in the technology of this invention.

It will be appreciated that other modifications or variations may be made to the invention disclosed herein without departing from the scope of this invention.

What I claim is:

1. A perforating gun wall that withstands short, high energy pulses of an explosion for retaining a loading tube, wherein the gun wall has at least two metal layers, wherein each metal layer comprises a defined property that reduces occurrences of catastrophic failure, and wherein the defined material property is a member of the group consisting of ultimate tensile strength, impact strength, ductility, elasticity, shock absorption, coefficient of thermal expansion, melting temperature, and vaporization temperature.

2. The perforating gun wall of claim 1, wherein at least one defined material property of one layer differs from a defined material property of at least another layer.

3. The gun wall of claim 1, wherein one metal layer comprises material fibers.

4. The gun wall of claim 1, wherein at least one metal layer has a non-uniform wall thickness.

5. The gun wall of claim 1, wherein the metal layer comprises at least one hole.

6. The gun wall of claim 5, wherein at least two holes are radially aligned.

7. The gun wall of claim 5, wherein the diameter of the at least one hole varies.

8. The gun wall of claim 5, wherein the diameter of the at least one hole on one of the two layers is different than the diameter of a hole on another of the layers.

9. The gun wall of claim 5, wherein the radius of the hole circumference is not constant.

* * * * *